United States Patent [19]

Koumura et al.

[11] 4,240,739

[45] Dec. 23, 1980

[54] ELECTROSTATIC COPYING APPARATUS

[75] Inventors: Noboru Koumura, Narashino; Toshiyuki Komatsu, Kawasaki; Katsumi Nakagawa, Tokyo; Nobuhiro Takekawa, Tokyo; Motoharu Fujii, Tokyo, all of Japan

[73] Assignee: Canon Kabushiki Kaisha, Tokyo, Japan

[21] Appl. No.: 794,224

[22] Filed: May 5, 1977

[30] Foreign Application Priority Data

May 17, 1976 [JP] Japan ..... 51/56258

[51] Int. Cl.[2] ..... G03G 15/00

[52] U.S. Cl. ..... 355/3 R; 355/14 R; 355/16

[58] Field of Search ..... 355/3 R, 4, 14, 16, 355/3 BE, 14 R

[56] References Cited

U.S. PATENT DOCUMENTS

| | | | |
|---|---|---|---|
| 3,090,287 | 5/1963 | Ritzerfeld et al. | 355/14 X |
| 3,736,055 | 5/1973 | Davidge et al. | 355/14 |
| 3,903,795 | 9/1975 | Suzuki | 101/415.1 X |
| 3,918,971 | 11/1975 | Zweig | 355/3 R X |
| 4,036,556 | 7/1977 | Knight et al. | 355/14 |
| 4,057,016 | 11/1977 | Endo et al. | 355/3 R X |

*Primary Examiner*—Fred L. Braun

*Attorney, Agent, or Firm*—Fitzpatrick, Cella, Harper & Scinto

[57] ABSTRACT

An automatic printing apparatus includes an image formation member for forming a master which may be repetitively subjected to the process of reproducing an original image, a rotatable drum capable of holding the image formation member thereon, an optical device for projecting therethrough the original image upon the image formation member on the rotatable drum, a heating member for heating the image formation member on the rotatable drum so as to form a chargeable image pattern corresponding to the image formed on the image formation member by the optical device, a charging device for forming an electrostatic image corresponding to the original image on the master formed by the optical device and the heating member, a developing device for developing the electrostatic image into a visible image, and a device for transferring the visible image from the master onto a recording medium.

15 Claims, 38 Drawing Figures

| FIG. 2A | FIG. 2B |
|---|---|

FIG. 6-a
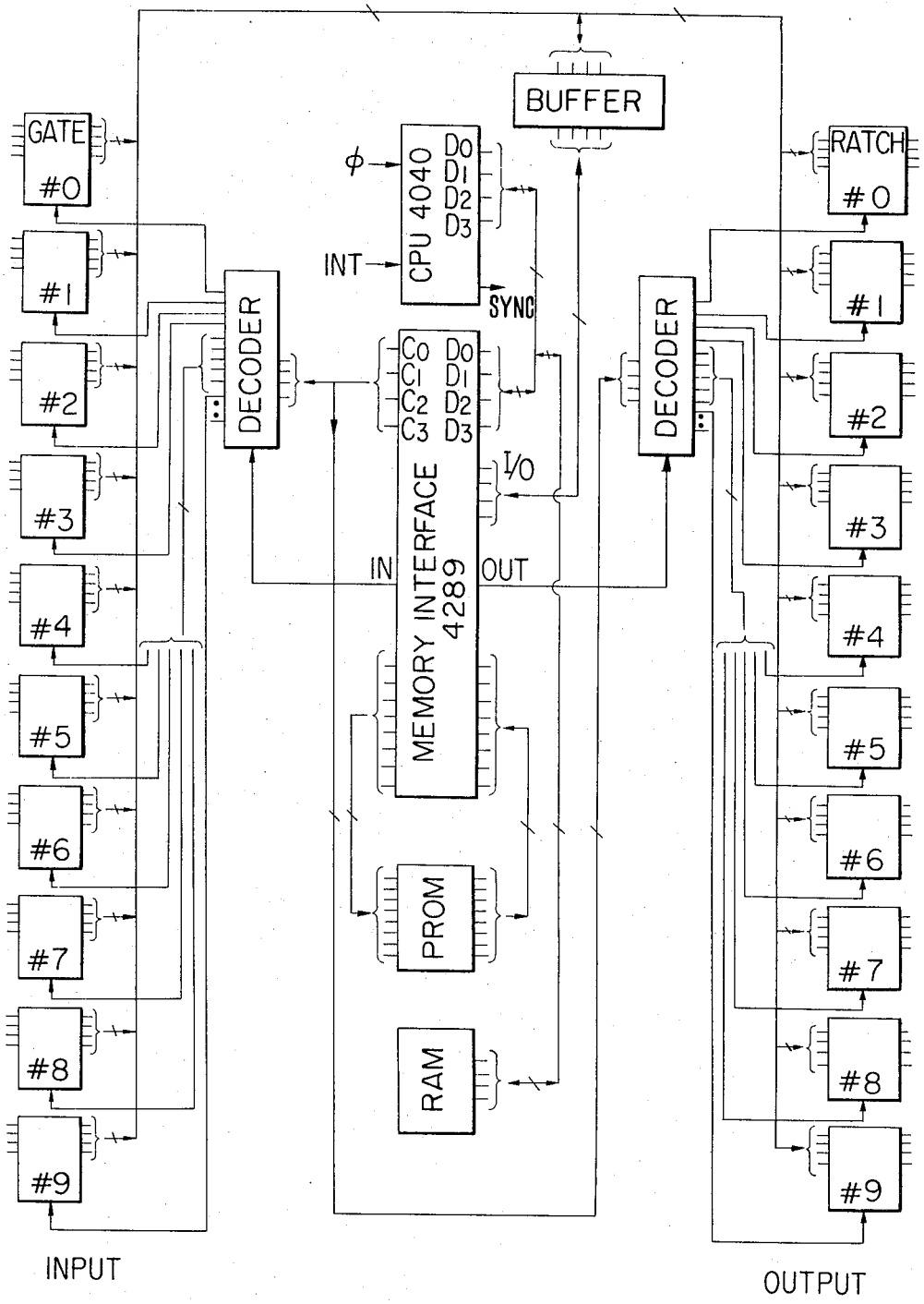

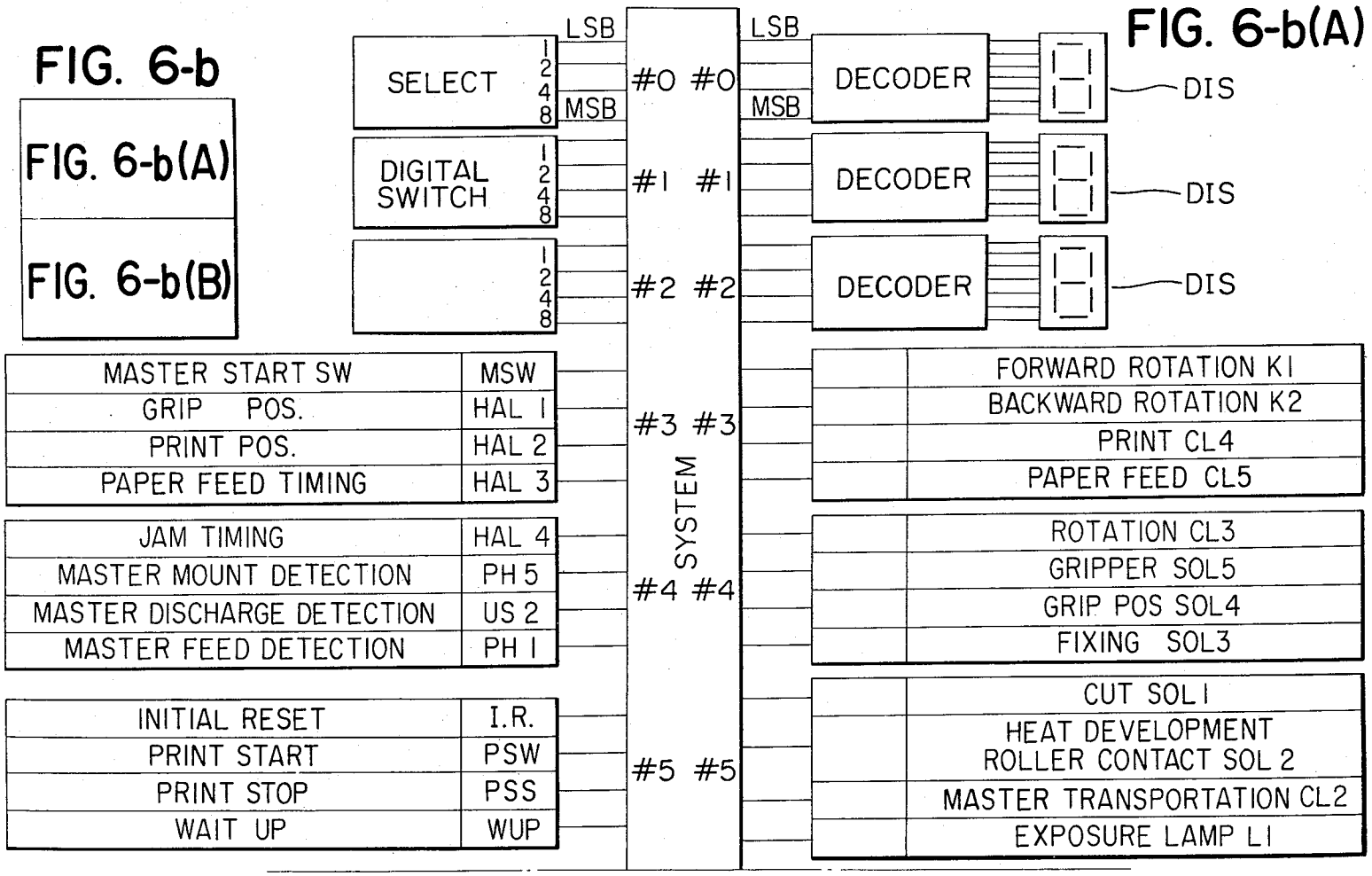
FIG. 6-b(A)
DIS
DIS
DIS
DECODER
DECODER
DECODER
LSB
MSB
#0 #0
#1 #1
#2 #2
#3 #3
#4 #4
#5 #5
SYSTEM
FORWARD ROTATION K1
BACKWARD ROTATION K2
PRINT CL4
PAPER FEED CL5
ROTATION CL3
GRIPPER SOL5
GRIP POS SOL4
FIXING SOL3
CUT SOL1
HEAT DEVELOPMENT ROLLER CONTACT SOL 2
MASTER TRANSPORTATION CL2
EXPOSURE LAMP L1
SELECT
DIGITAL SWITCH
1 2 4 8
MSW
HAL 1
HAL 2
HAL 3
HAL 4
PH 5
US 2
PH 1
I.R.
PSW
PSS
WUP
MASTER START SW
GRIP POS.
PRINT POS.
PAPER FEED TIMING
JAM TIMING
MASTER MOUNT DETECTION
MASTER DISCHARGE DETECTION
MASTER FEED DETECTION
INITIAL RESET
PRINT START
PRINT STOP
WAIT UP
FIG. 6-b
FIG. 6-b(A)
FIG. 6-b(B)

FIG. 6-b(B)
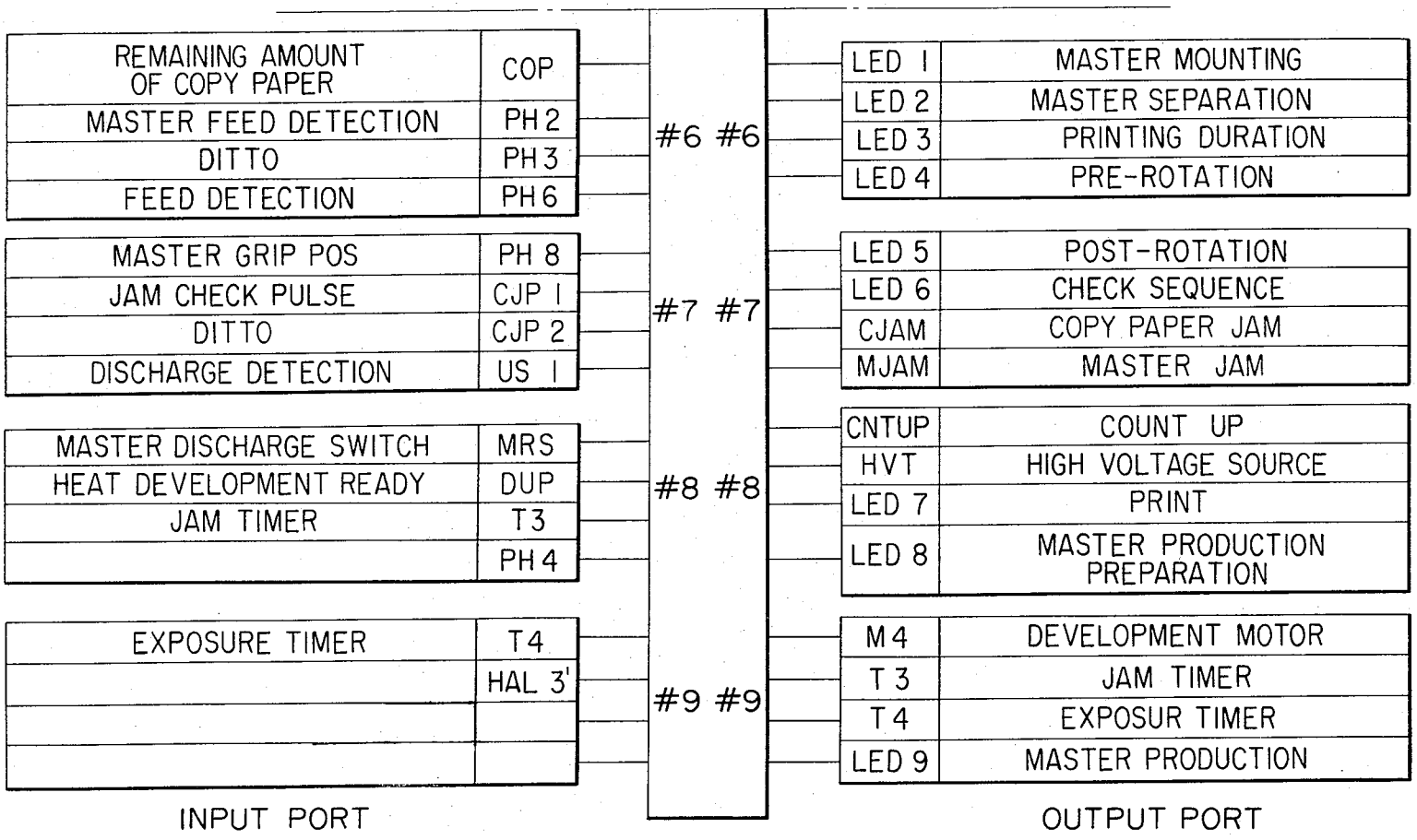

FIG. 9-a(A)
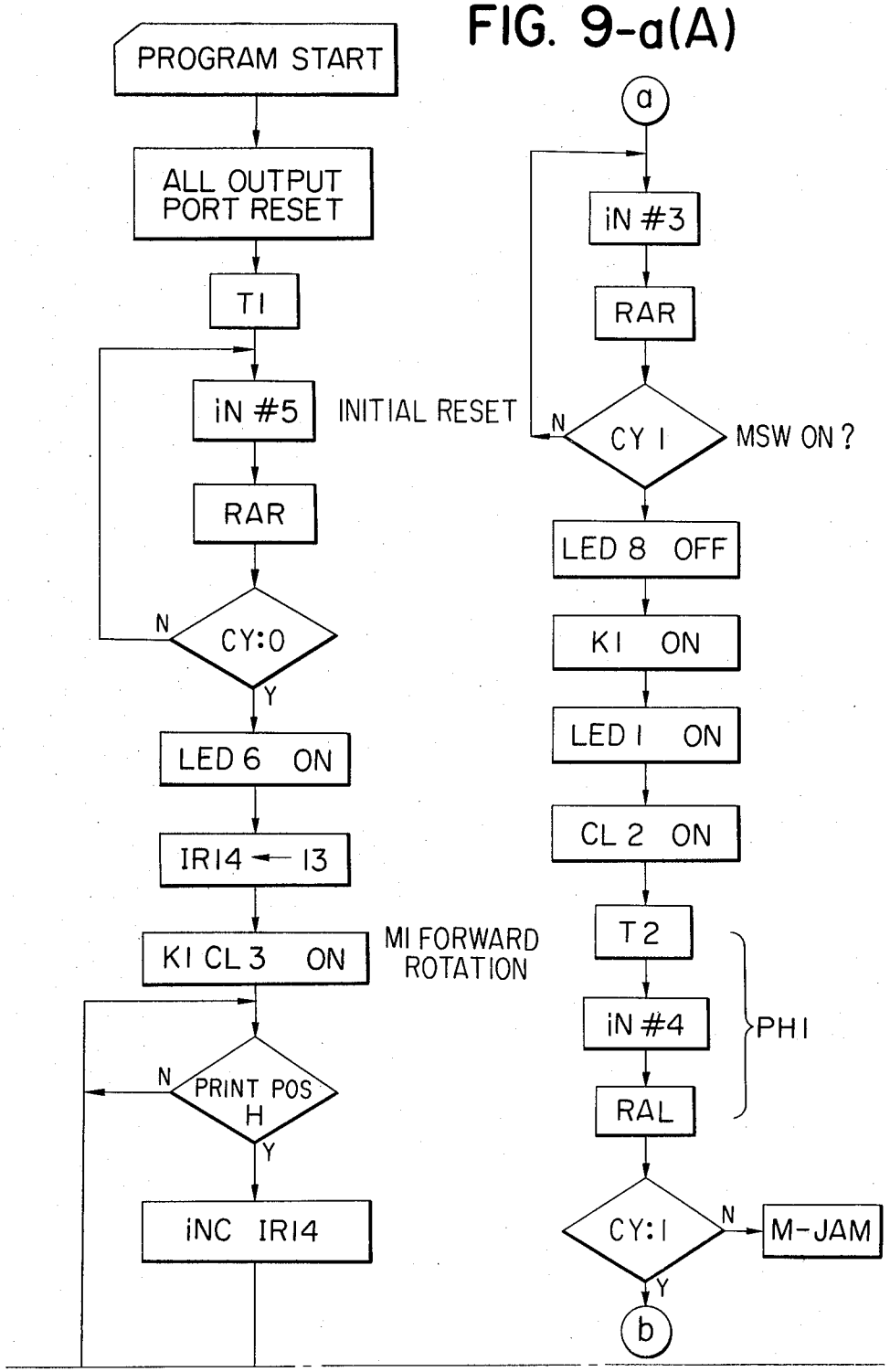

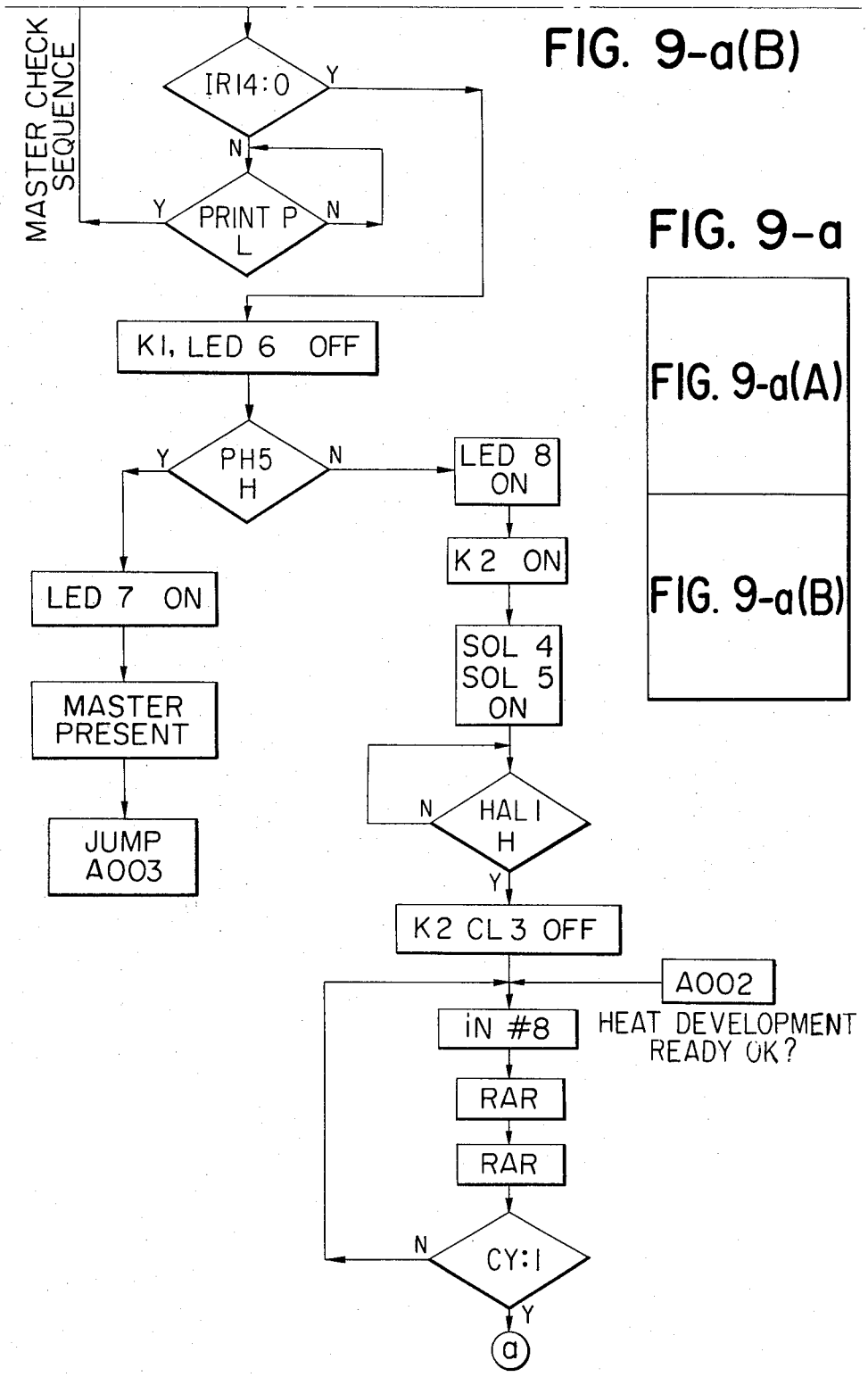
FIG. 9-a
FIG. 9-a(A)
FIG. 9-a(B)

FIG. 9-b(A)
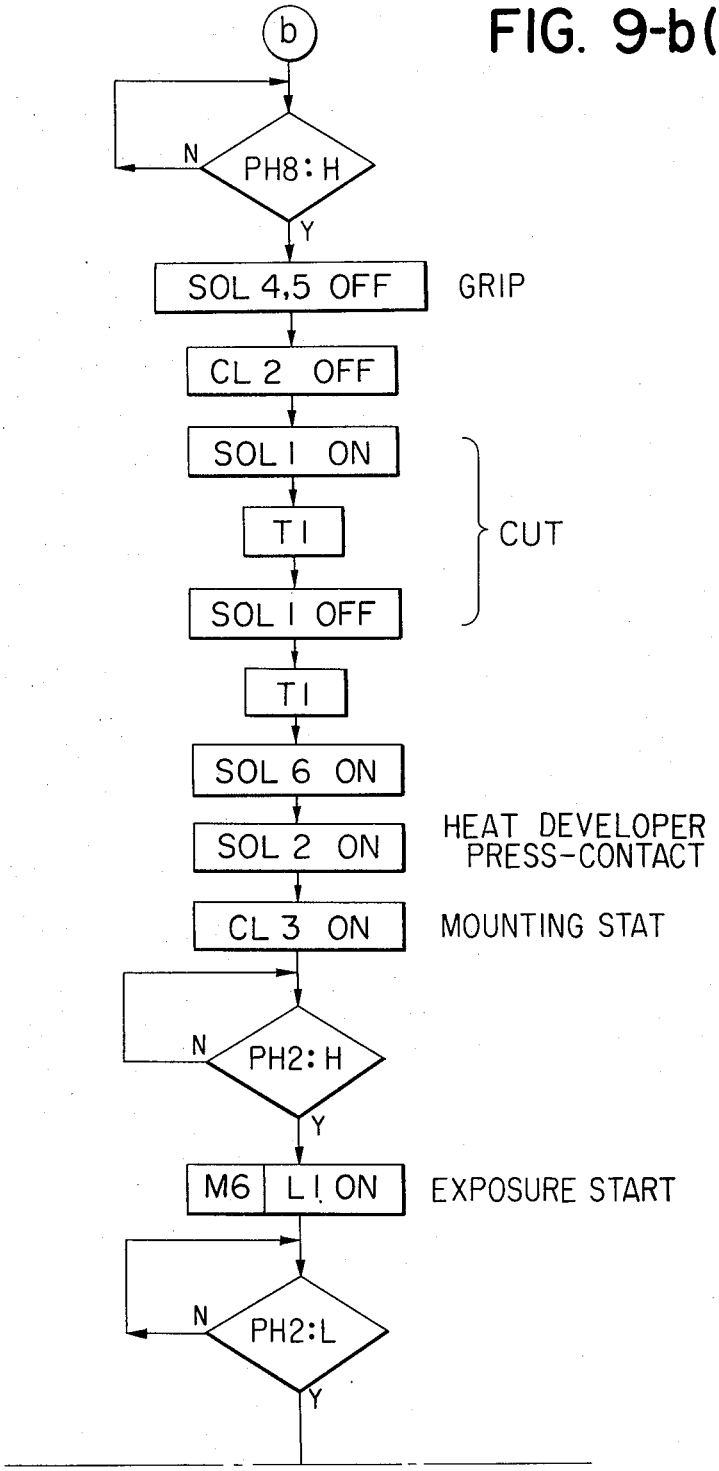

FIG. 9-b(B)
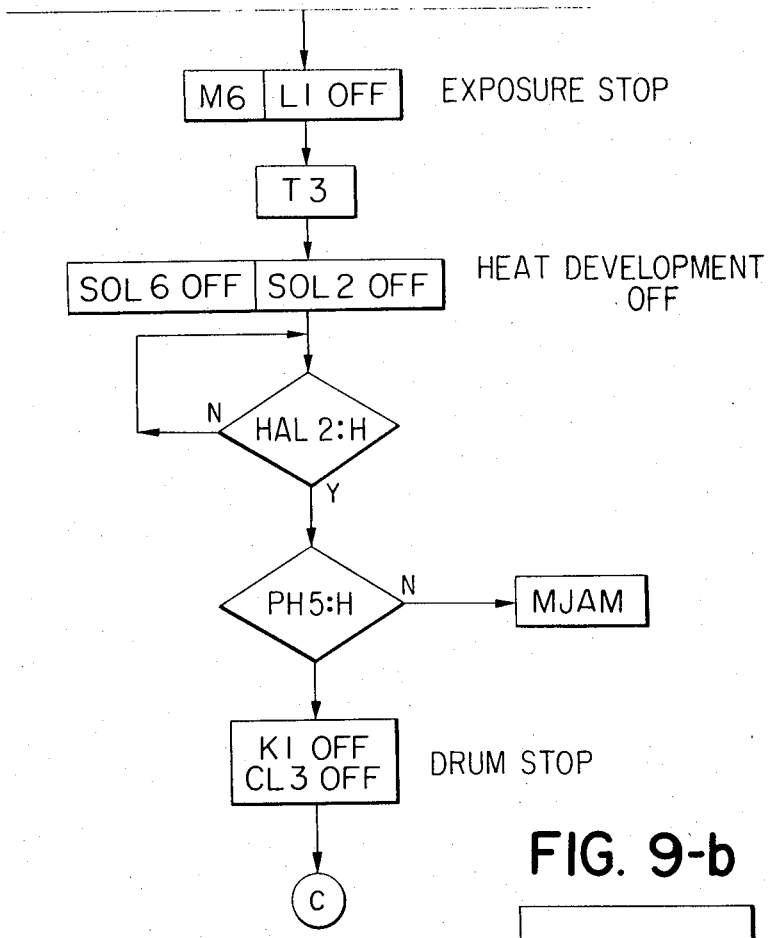
FIG. 9-b
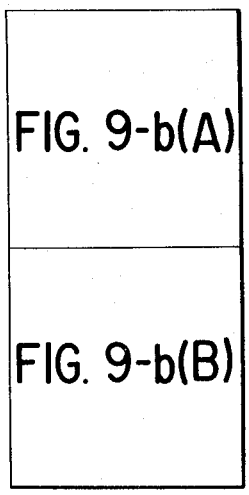

FIG. 9-c(A)
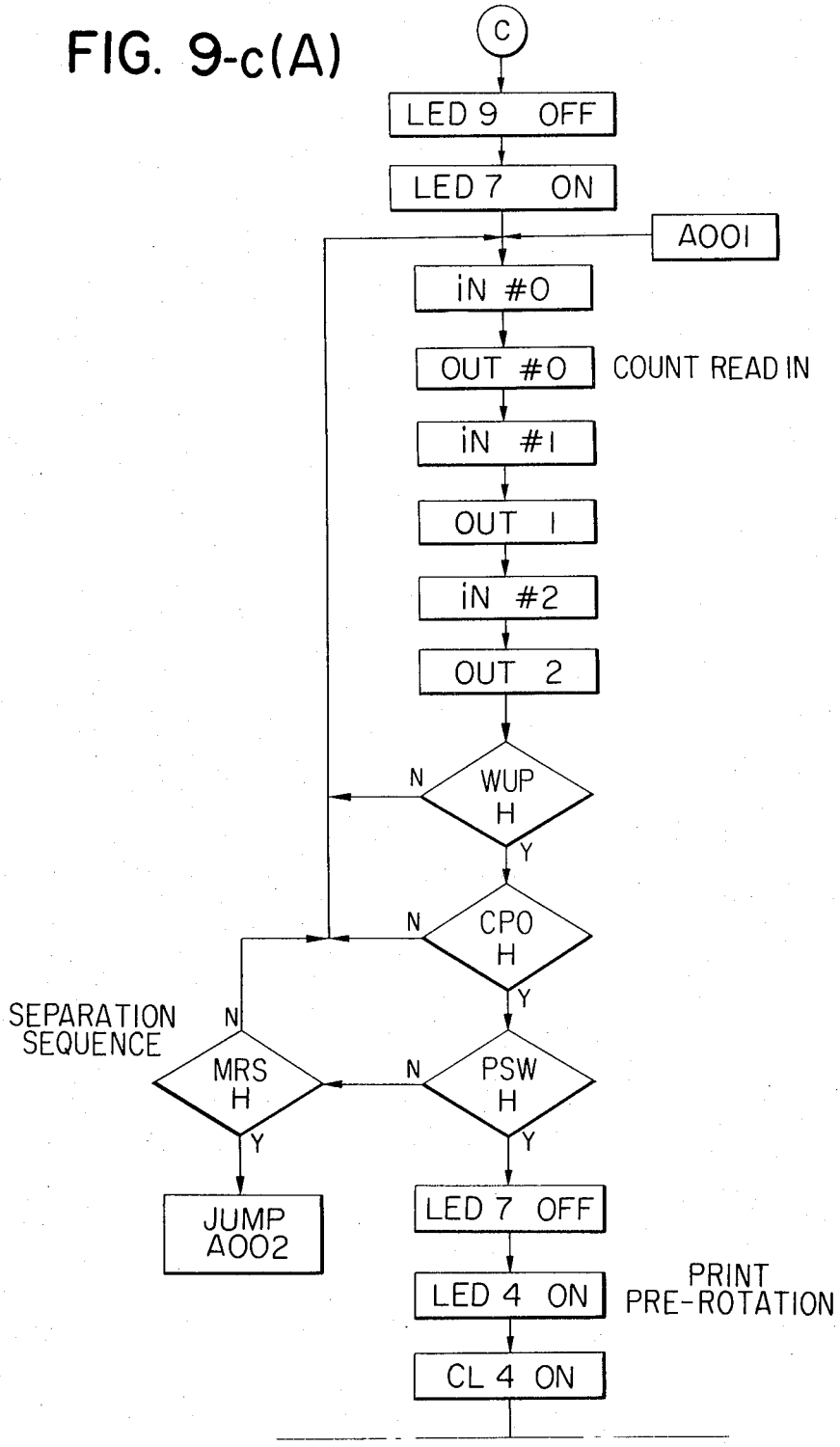

FIG. 9-c(B)
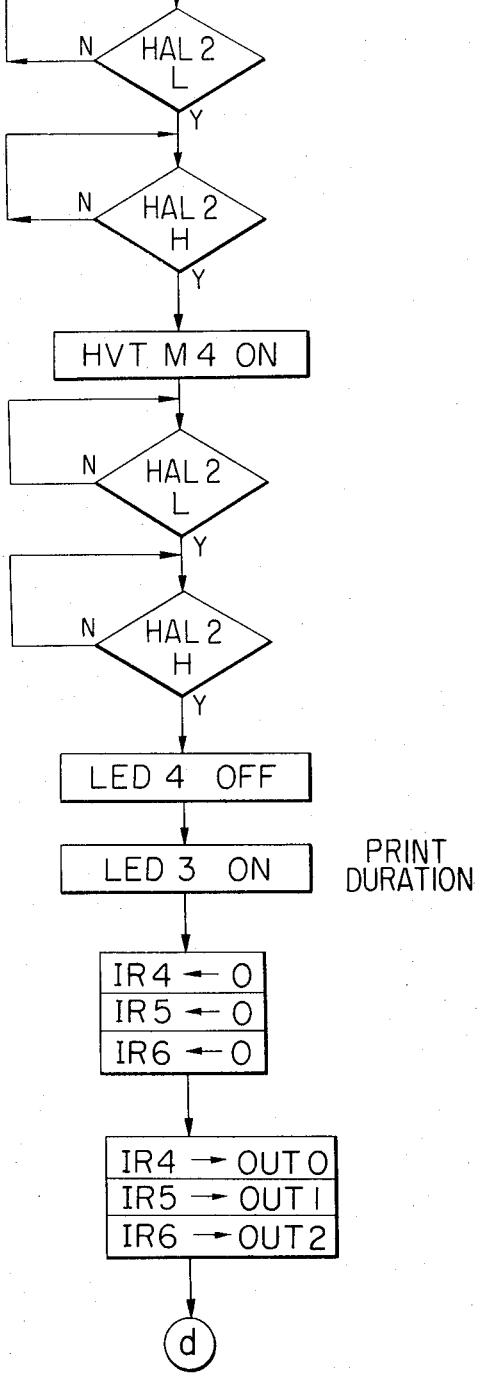
FIG. 9-c
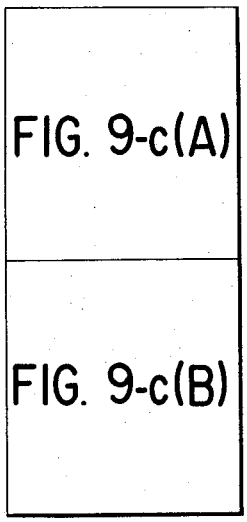

FIG. 9-d(A)
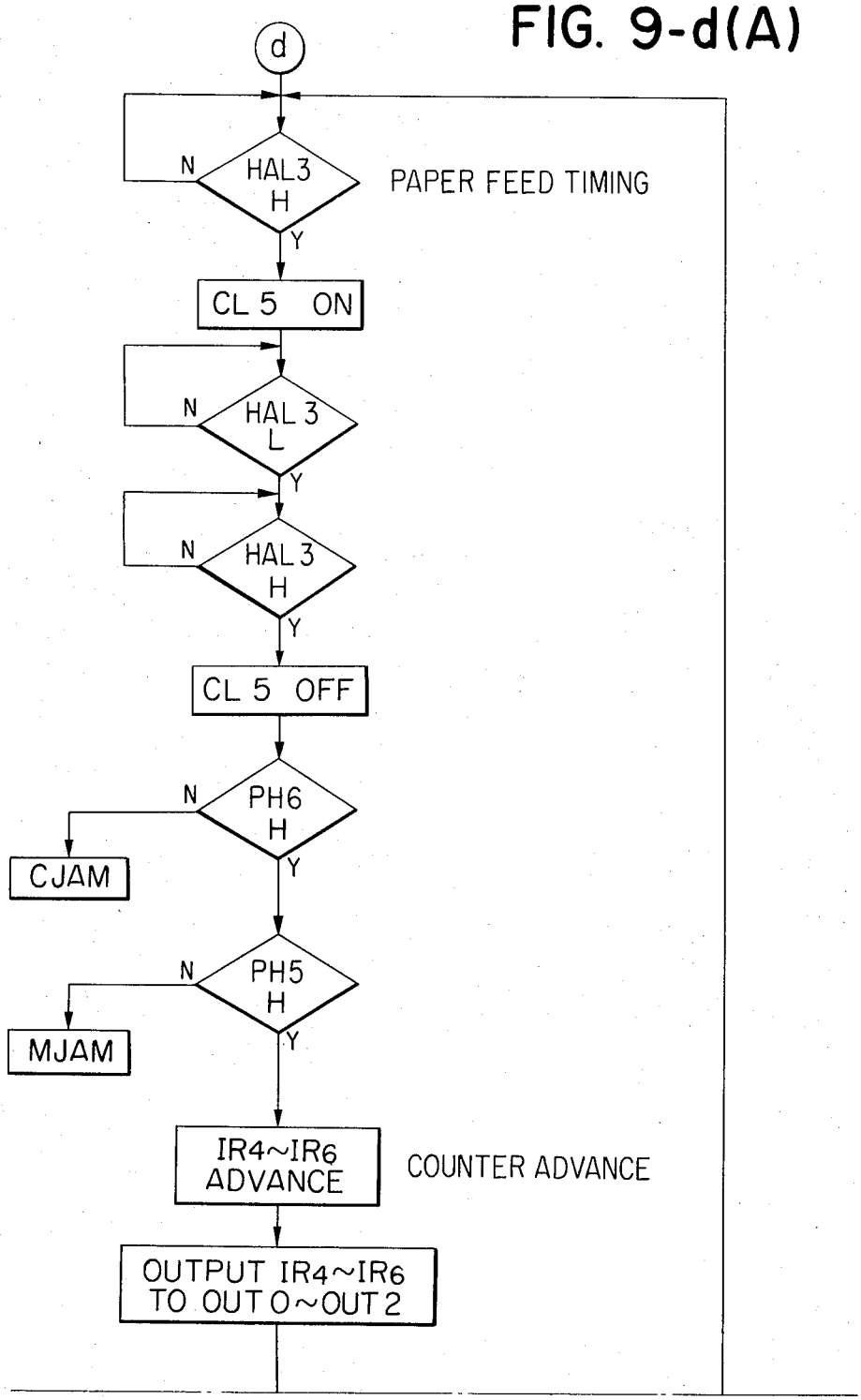

FIG. 9-d(B)
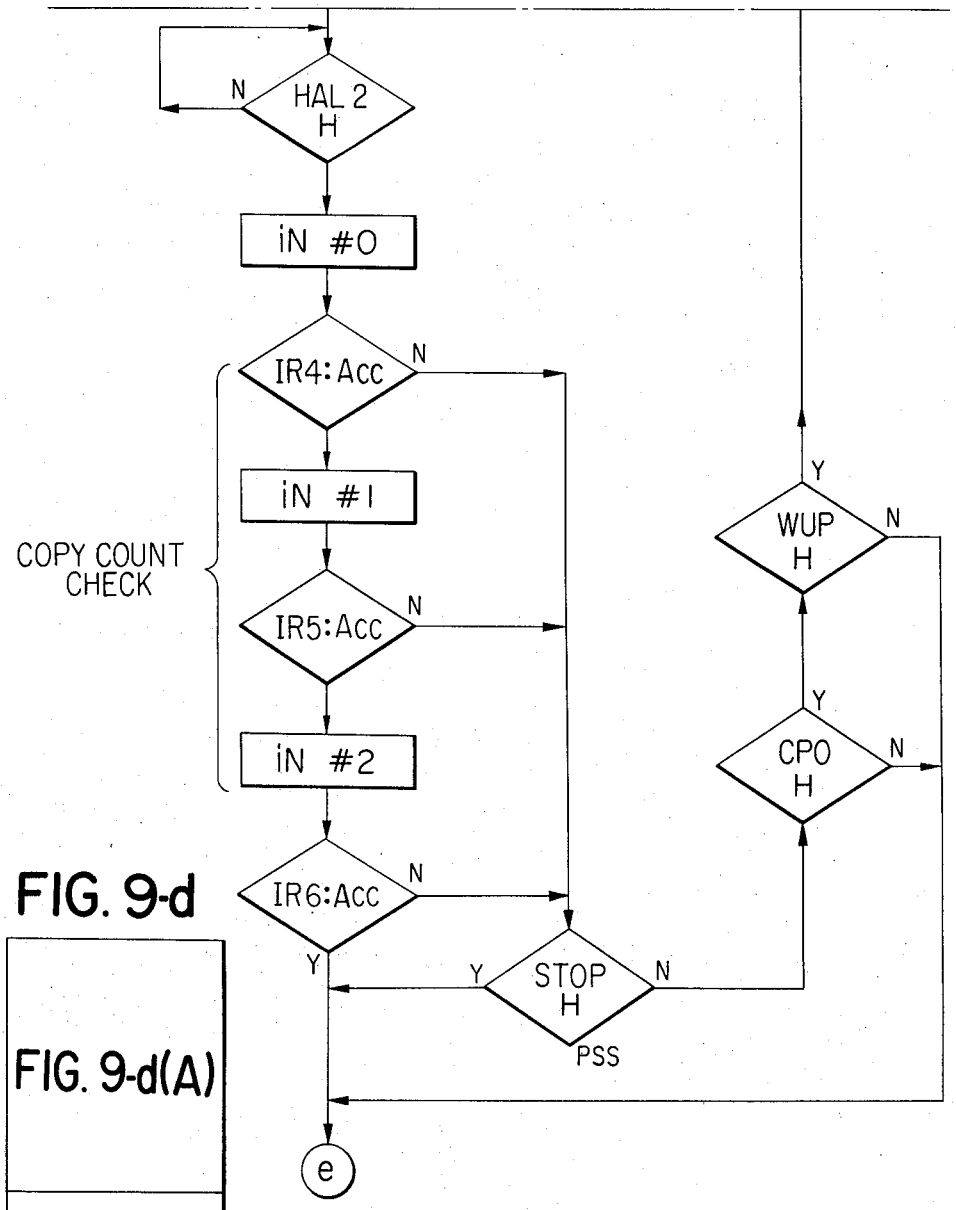
FIG. 9-d
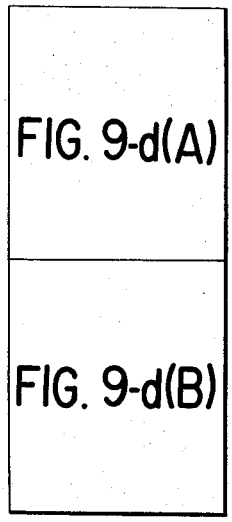

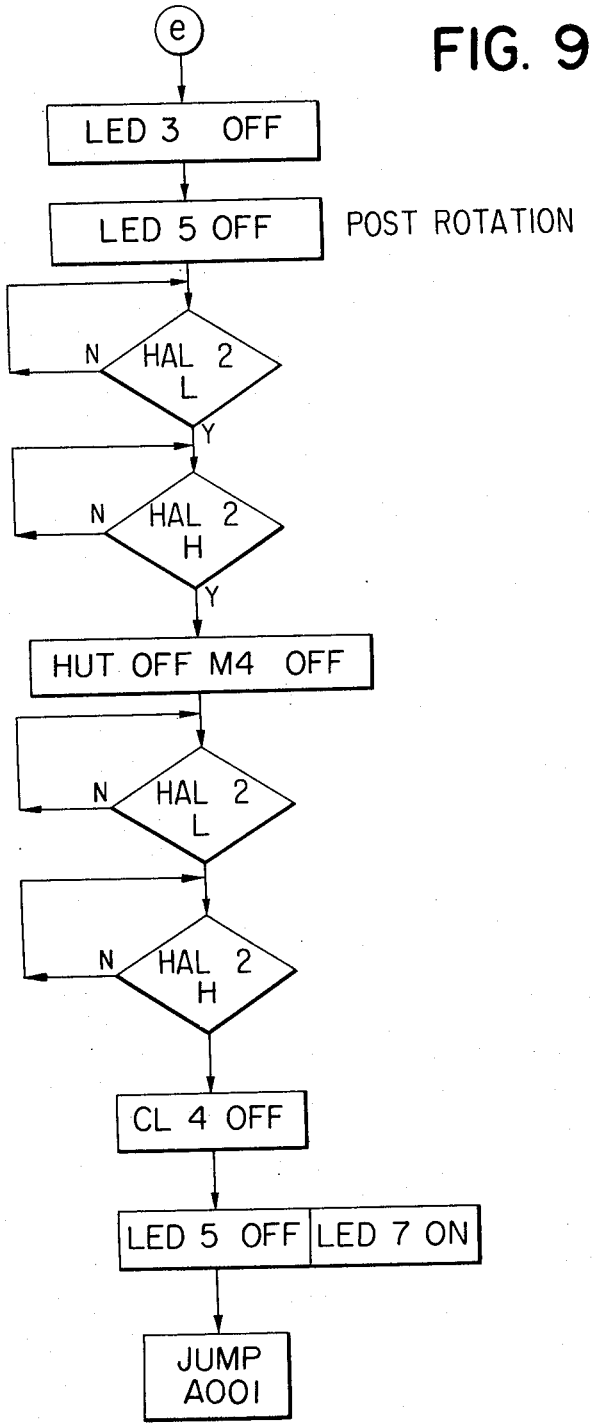
FIG. 9-e(A)
FIG. 9-e
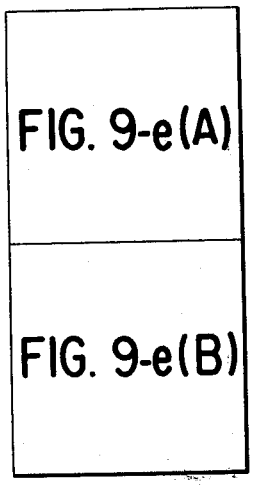

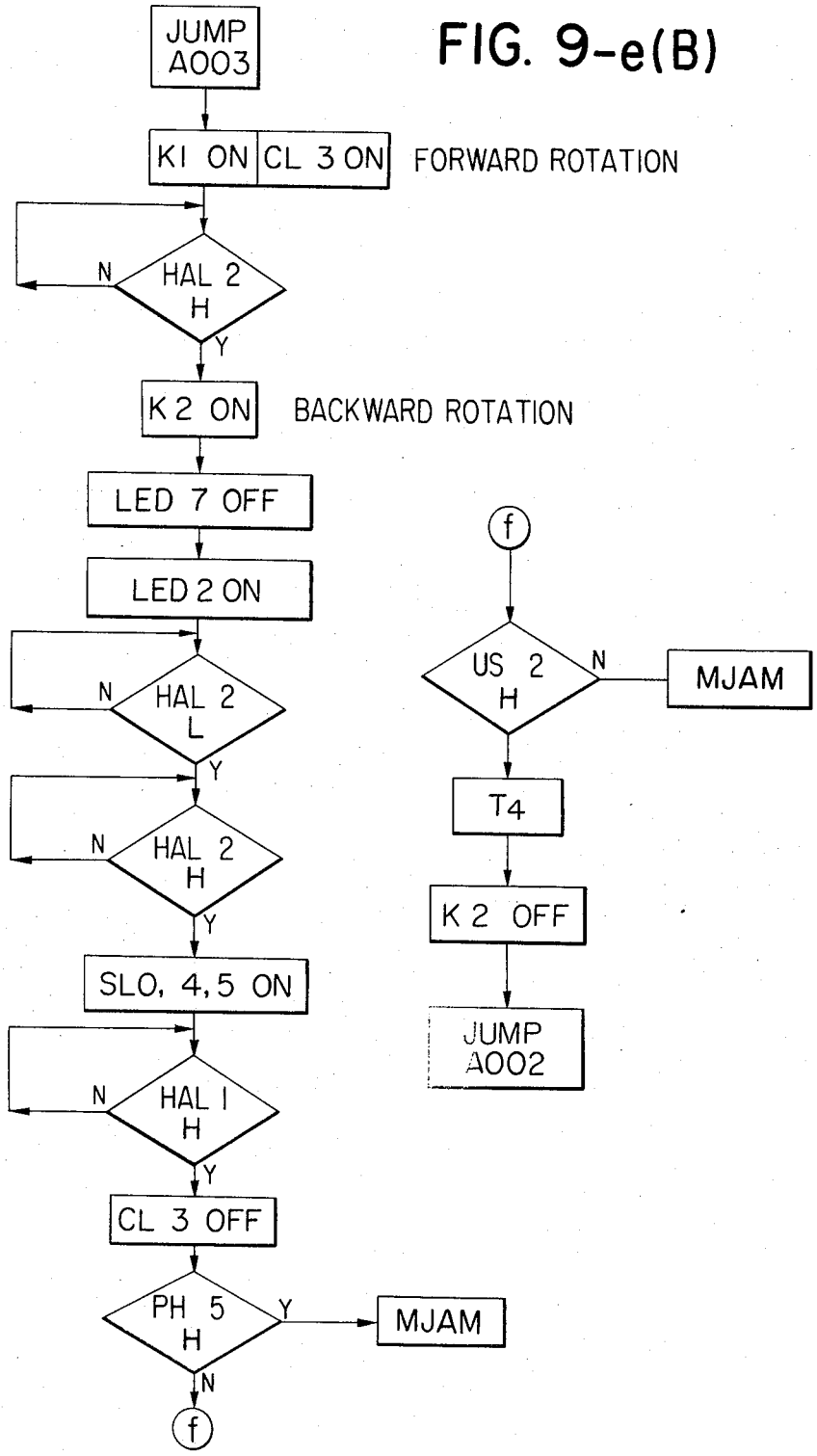
FIG. 9-e(B)
JUMP A003
K1 ON
CL 3 ON
FORWARD ROTATION
HAL 2 H
N
Y
K 2 ON
BACKWARD ROTATION
LED 7 OFF
LED 2 ON
HAL 2 L
HAL 2 H
SLO, 4,5 ON
HAL 1 H
CL 3 OFF
PH 5 H
MJAM
f
US 2 H
T4
K 2 OFF
JUMP A002

FIG. 9-f
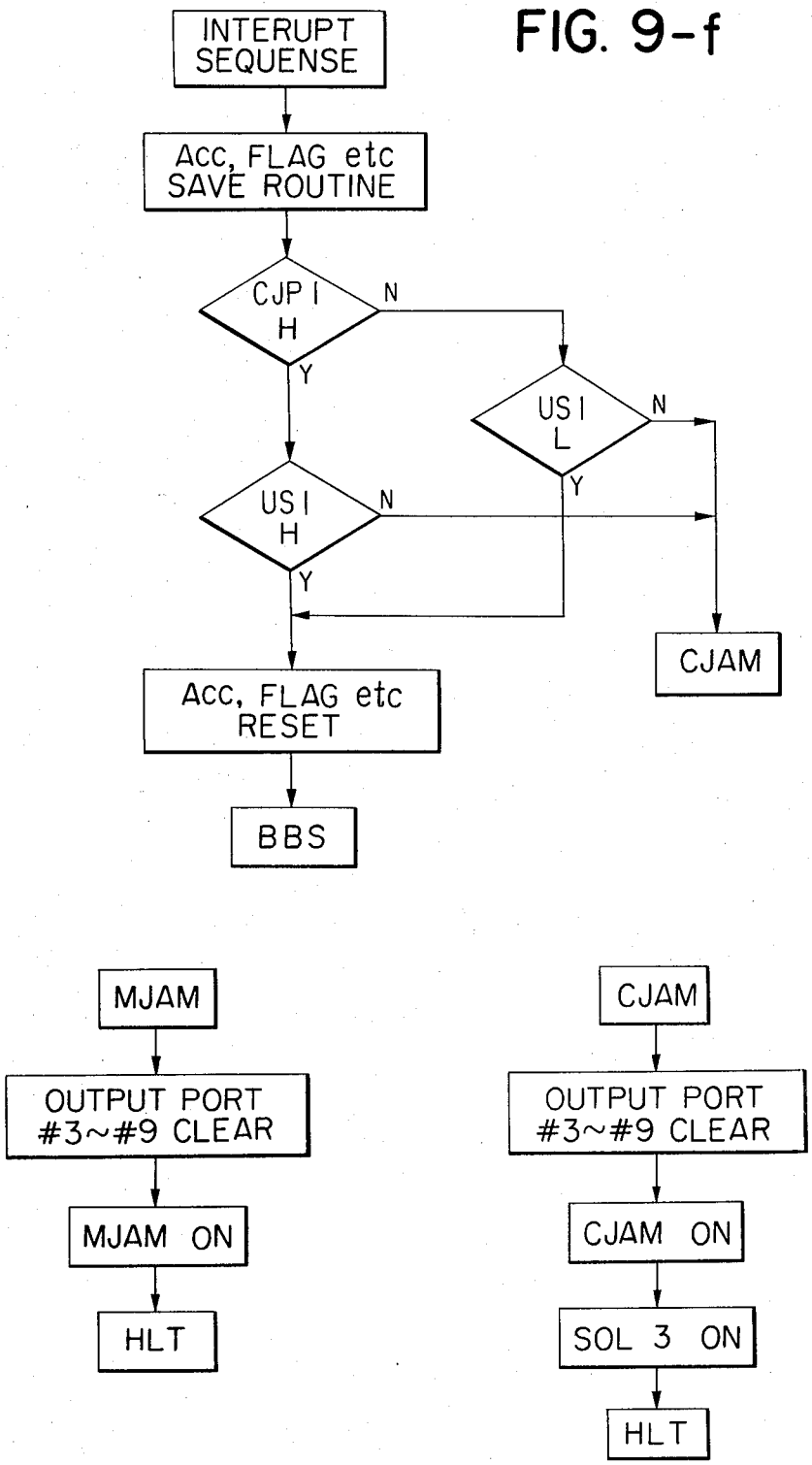

ELECTROSTATIC COPYING APPARATUS

BACKGROUND OF THE INVENTION a. Field of the Invention

This invention relates to an automatic printing apparatus, and more particularly to an automatic printing apparatus which can automatically and continuously execute a sequence of printing and treating processes from the formation to the printing of an image formation member having an image pattern already formed thereon which may repetitively be subjected to the image reproducing process (hereinafter referred to as the master).

The term "image formation member" used herein means a member having no image pattern formed thereon which may repetitively be subjected to the image reproducing process.

The term "master" used herein means a member having an image pattern already formed thereon which may repetitively be subjected to the image reproducing process.

b. Description of the Prior Art

In the age of information like now, ways of communication are more and more diviersified and correspondingly, the paper work as means of communication inside and outside offices is not only in the tendency toward increased quantities of copies (duplicates and prints) and increased copy cost, but also strong demand for higher copying speed and higher quality of copies comes from the user and there is a great desire for the exploitation of an apparatus for reproducing image originals such as documents and the like which is endowed with various desirable properties such as high speed, conformability, instantaneity, high reliability, ease of maintenance, etc.

In answer to such desire, there have been exploited or proposed various apparatuses in the fields of copying and printing. One of them is a printer which is equipped with an image reproducing process unit capable of executing an image reproducing process like the electrostatic printing process for forming duplicates of original documents on paper or the like. Such printer usually includes a master preparation process section and a plurality of process sections which may execute their functions when predetermined processing operations such as electrical charging, development, image transfer, fixation, etc. are to be carried out for the image reproducing process.

The master usable with such a printing apparatus may be one formed as by an electrically insulative substance such as synthetic resin or the like provided on an electrically conductive substrate and having an image pattern formed thereon corresponding to the image of an original document to be reproduced, or one having such an image pattern formed on a metal sheet by the use of photoresist, photopolymer or the like, or one having an electrically insulative resin image formed as on a copy sheet of zinc oxide through the known electrophotographic process and the image pattern on any of these masters may be repetitively subjected to the image reproducing process.

However, the process of forming and treating these masters includes a number of steps and is often cumbersome and complicated and time-consuming because it includes the wet type treatment, and therefore the printing apparatus including a process section for executing the treating process for forming such as master is poor in instantaneity, conformability, operability, simplicity, etc. Further, a printing apparatus using the copy sheet of zinc oxide involves a number of steps because the formation and treatment of the master therein includes procedures such as charging, exposure, development, fixation, etc. and moreover, the process arrangement having process sections for executing these processes is not often permitted to serve also as the process arrangement having process sections executing the procedures such as charging, development, image transfer, fixation, etc. which are involved in the electrostatic printing process, and accordingly, an independent section for forming and treating the master must be added, thus generally increasing the size of the apparatus. Furthermore, a master made from a copy sheet of zinc oxide essentially creates a fog potential which results in creation of the ground fog in the reproduced image (duplicate image). Thus, it is necessary during the execution of the electrostatic printing process that the step of applying the procedure of whole surface exposure be added before the developing step is executed, or that the step of applying a bias voltage higher than usual be added during the developing step, and also that some countermeasure be taken to overcome the disadvantage resulting from the presence of electrical resistance spots on the photosensitive layer of zinc oxide resin or its back-up member which is paper, which resistance spots may often appear conspicuously in the form of density spots in the optical density half-tone region of a reproduced image when provided as the result of the electrostatic printing process. Therefore, it is further necessary to provide a processing section which may be accurately controlled to execute these procedures.

In addition, the image pattern on any of the above-described masters is formed by concavo-convexity and when repetitively subjected to the electrostatic printing process, the concavo-convex surface of the master may be injured by mechanical friction so that the image pattern may be disturbed or may create spots of charge, with a resultant problem that the quality of the reproduced image may be reduced in accordance with the frequency with which the electrostatic printing process is repeated for the same master.

Furthermore, the printing apparatus so far described requires professional technique for adjusting and operating the processing sections executing the formation and treatment of a master, which in turn leads to the necessity for a highly trained professional operator to take in charge of the apparatus.

As noted above, the printing apparatus of the prior art may not be said to sufficiently meet the user's desire in respect of the problems concerning the master preparation and treating process and adjustment and operation of the process section therefor, as well as the problem concerning the master so formed.

SUMMARY OF THE INVENTION

It is an object of the present invention to provide an automatic printing apparatus having an high performance which eliminates employment of any professional operator and may be simply and quickly operated even by any layman to effect not only the printing of a few number of sheets but also multisheet, high-speed printing from one and the same original document.

It is another object of the present invention to provide an automatic printing apparatus which is organically systematized in terms of economy, versatility, operational simplicity, image reproducibility, etc.

It is still another object of the present invention to provide an automatic printing apparatus which is compact and highly reliable and which enables the master processing and the printing process to be executed at the same stage.

It is another specific object of the present invention to provide an automatic printing apparatus in which the image of an original is projected upon an image formation member on a drum to prepare a master through heat development and the master on the same drum is repetitively subjected to the steps of charging, development and image transfer, thereby continuously and repetitively producing prints.

It is a further object of the present invention to provide an automatic printing apparatus in which the master on the drum may be separated from the drum by movement of the drum in backward direction.

It is a further object of the present invention to provide an automatic printing apparatus in which heating means may be spaced apart from the master on the drum when the printing process is effected on the master.

It is a further object of the present invention to provide an automatic printing apparatus having a secondary charging section for detecting the charged condition on the master to effect necessary charging in accordance therewith and for properly correcting the charged condition thereafter.

It is a further object of the present invention to provide an automatic printing apparatus in which an image formation member may be mounted on the rotatable drum with the leading end of the image formation member overlapping the trailing end thereof.

It is a further object of the present invention to provide an automatic apparatus in which the leading end of the image formation member is mounted on the rotatable drum while the trailing end of the image formation member is free with respect to the rotatable drum.

It is a further object of the present invention to provide a printing apparatus in which the process of preparing the master, the process of printing and the process of separating the master may be successively displayed to facilitate the operation of the apparatus.

It is a further object of the present invention to provide an automatic printing apparatus which eliminates cleaning means in the print processing steps.

It is a further object of the present invention to provide an automatic printing apparatus in which cleaning means is intermittently operated in the print processing steps.

It is a further important object of the present invention to provide an automatic printing apparatus in which the rotation start position of the rotatable drum in which leading end of the image formation member is seized and held by the rotatable drum (the first start position) differs from the position in which the rotation of the rotatable drum is resumed to repetitively subject the master, once formed, to the print processing steps such as charging, development, image transfer, etc. (the second start position).

It is a further object of the present invention to provide an automatic printing apparatus in which the rotatable drum with the image formation member held thereon starts rotating from the first start position and stops rotating at the second start position, thus becoming ready to start the print processing steps.

It is a further object of the present invention to provide an automatic printing apparatus in which the rotatable drum starts the print processing from the second start position and continues it repetitively, whereafter the drum stops at the first start position, thus rendering the image formation member ready to be held on the rotatable drum.

It is a further object of the present invention to provide an automatic printing apparatus in which the image reproducing and processing operation is combined with further various special functions and characteristics.

The above objects and features of the present invention will become more fully apparent from the following detailed description of the invention taken in conjunction with the accompanying drawings.

BRIEF DESCRIPTION OF THE DRAWINGS

FIG. 2 is a vertical cross-sectional view of a first embodiment of the present invention, wherein FIGS. 2A and 2B are combined along the broken lines thereof to form a single view.

FIGS. 6*a* and 6*b* diagrammatically show an example of the control circuit in the present invention, wherein FIGS. 6*b* (A) and 6*b* (B) are combined along the broken lines thereof to form a single view.

FIG. 7 is a time chart for illustrating the operation of the present invention, wherein

FIGS. 9-*a* to 9-*f* are control flow charts, wherein FIGS. 9*a*(A) and 9*a*(B), 9*b*(A) and 9*b*(B), 9*c*(A) and 9*c*(B), 9*d*(A) and 9*d*(B), and 9*e*(A) and 9*e*(B) are respectively combined along the broken lines thereof to form a single view.

DESCRIPTION OF THE PREFERRED EMBODIMENTS

Figure 1:
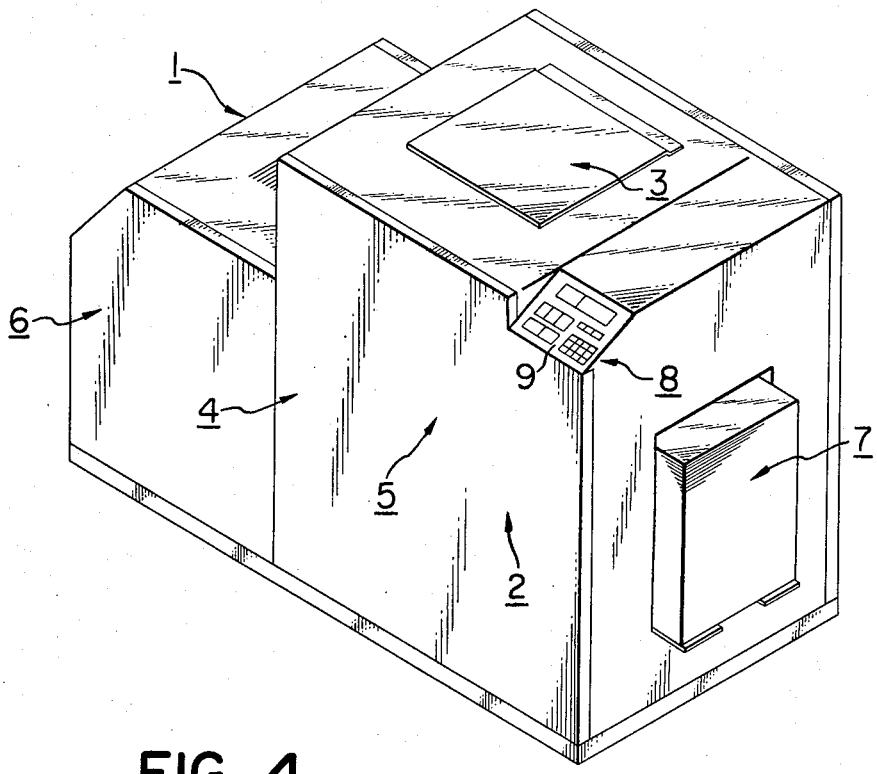
FIG. 1 is a pictorial perspective view of an automatic printing apparatus according to the present invention.

Referring to FIG. 1, there is shown a characteristic automatic printing appartus of the present invention. A great feature of the automatic printing apparatus 1 shown in FIG. 1 is that it is arranged such that the process of preparing a master for electrostatic printing and the process of electrostatic printing are executed at one stage.

The automatic printing apparatus 1 has an image formation member containing section 2 capable of containing image formation members which may be used as masters by being subjected to the master preparation process, an exposure section 3 including exposure means for exposing an original document to be reproduced which is installed at a predetermined image forming position and for projecting the image light resulting from the exposure onto an image formation member conveyed to a predetermined position, a heat developing section 4 including process means for applying the heat developing process to the image formation member exposed, and an electrostatic print processing section 5 including electrostatic print process means. This apparatus is capable of perfectly automatically effecting the following: conveying the image formation member from the image formation member containing section 2 to the predetermined position; exposing the original document to be reproduced which is installed at the predetermined image forming position, projecting the image light resulting from the exposure onto the image formation member conveyed to the predetermined position, and subjecting the image formation member to the heat developing process to thereby prepare a master for electrostatic printing; and subsequently executing the electrostatic printing process in accordance with a predetermined program by the use of the master so prepared. The electrostatic print processing section 5 has a charging section including charging means for applying the charging process to the prepared master to form thereon an electrostatic latent image, a developing section 12 including developing means for visualizing the electrostatic latent image, an image transfer section including means for transferring the developed image from the master to a sheet of transfer paper conveyed there with exact timing, and a separating section for separating the transfer paper from the master after the image transfer has been effected.

The automatic printing apparatus 1 further has a fixing section 6 including means for semi-permanently fixing the image on the transfer paper, and a conveying section including means for conveying the transfer paper from the separating section to the fixing section 6.

The transfer paper, after conveyed from a transfer paper handling section 7 to the electrostatic print processing section 5, is subjected to a final processing at the fixing section 6 to thereby form a semi-permanently fixed copy image, whereafter the transfer paper is conveyed to a paper discharge section. The paper discharge section may comprise a well-known tray or a sorter which is capable of classifying sheets of oncoming transfer paper bearing fixed final images and containing them at a number of predetermined positions.

The functions of the above-described various processing sections are executed under properly timed sequence control.

The automatic printing apparatus 1 has a central control unit 8 including part of the means for starting, interrupting, restarting, stopping and terminating the processing operations of the various processing sections effected under such a sequence control. The central control unit 8 in turn has a front control panel 9 including a number of operating switches for causing the various processing sections to execute their respective functions and for programming so that a particular processing section executes a particular function, and a plurality of display surfaces for displaying a particular purpose or instruction of the operator.

The internal construction of the automatic printing apparatus 1 shown in FIG. 1 and the operations of the various processing sections will now be described by reference to FIG. 2 which illustrates recording process means for repeatedly effecting an image forming, developing, and transfer process as described below.

The automatic printing apparatus 1 has a drum 10 disposed in place therewithin and rotatably mounted, the drum being a processing stage on which the master preparation process and the electrostatic printing process are executed. On the drum 10, an image formation sheet S having a predetermined length conveyed from the image formation sheet containing section 2 is wrappingly mounted and subjected to the master preparation process to prepare a master M. The master M so prepared remains there and is then subjected to the electrostatic printing process.

The drum 10 has therearound a plurality of processing sections for projecting the master preparation process and a plurality of processing sections for subjecting the master to the electrostatic printing process.

These processing sections are organically combined together by a sequence controlled with exact timing and execute their functions. The master preparation process is executed by the exposure section 3 including means for exposing an original document to light and projecting the image light of the original resulting from the exposure onto the image formation sheet S wrappingly mounted on the drum 10 and by the heat developing section 4 including means for heat-developing the exposed image formation sheet S.

The master M prepared by the image formation sheet being subjected to the heat developing process is further subjected to the electrostatic printing process to provide a copy image of the original document. The electrostatic printing process is executed by the charging section 11, the developing section 12, the image transfer section 13 and the cleaning section 14 which are disposed around the drum 10.

The image formation sheet containing section 2 is so constructed that a magazine 15 in which a roll of image formation sheet is set to a predetermined position. The setting of the magazine 15 may be accomplished by opening the door in a side wall of the apparatus 1, inserting the magazine onto a support shaft 16, passing the leading end of the image formation sheet along a guide roller 17 and having the leading end nipped by and between a pair of image formation sheet feed rollers **18*a* and 18*b*. When master preparation process execution signal is put out from the central control unit 8 to the image formation sheet containing section 2, a control signal is generated by a control unit 19 including electrical control means for controlling the various process sections in response to said execution signal, and the feed rollers 18*a* and 18*b* are driven in accordance with the generated control signal so that the leading end of the image formation sheet within the magazine 15 is guided along a transport path toward the drum 10. The leading end of the image formation sheet passes between five pairs of feed rollers 20*a* and 20*b*, 21*a* and 21*b*, 22*a* and 22*b*, 23*a* and 23*b*, 24*a* and 24*b* in succession and to the printing drum 10. The image formation sheet S so fed from the magazine 15 is cut by a cutter 27 which is operated by the instruction signal from the control unit 19 as soon as the leading end portion of the sheet S fed from the magazine 15 along the transport path reaches a predetermined length. On the other hand, the printing drum 10 is being position-controlled to assume such a position in which the opening 28 of the drum comes to face an insertion port 26 for the image formation sheet so as to enable the leading end of the image formation sheet to be seized by mount-dismount means 25** disposed within the drum.

The leading end of the image formation sheet S is inserted into the opening 28 of the drum 10 as it is at rest in its predetermined position, and then seized by the mount-dismount means 25 disposed within the drum 10. In response to a signal resulting from the detection of the fact that the leading end of the image formation sheet has been seized in proper position by the mount-dismount means 25, the drum 10 starts rotating at a predetermined velocity in the direction of the arrow indicated by solid line (counter-clockwise direction). With the rotation of the drum 10, the image formation sheet is wrappingly mounted on the outer peripheral surface of the drum 10 and exposed at the image forming position to the image light from the original document, and then subjected to the heat developing process at the heat developing section 4. The exposure section 3 for exposing the original document to light and projecting the resultant image light onto the image formation sheet as it passes through the image forming section has an original supporting plate 30 for supporting thereon the original document which may comprise, for example, a transparent glass plate, a movable light source 31 for illumination, and an optical system for projecting the image light from the original document onto the image forming section 29. The optical system comprises movable mirrors 32, 33, in-mirror lens 34 and stationary mirror 25.

With the rotation of the drum 10, the leading end of the image formation sheet mounted on the drum 10 comes to a predetermined position at the image forming section 29, whereupon the light source 31 included in the exposure section 3 is turned on in synchronism with the rotation of the drum 10 while the light source 31 and the mirrors 32, 33 start moving. As the result, successive portions of the entire surface of the original document are projected upon the image formation sheet at the image forming section 29.

When an end-of-exposure signal is put out by the control unit 19, the light source 31 is turned off and returned to its initial position with the mirrors 32 and 33.

Figures 2, 2A:
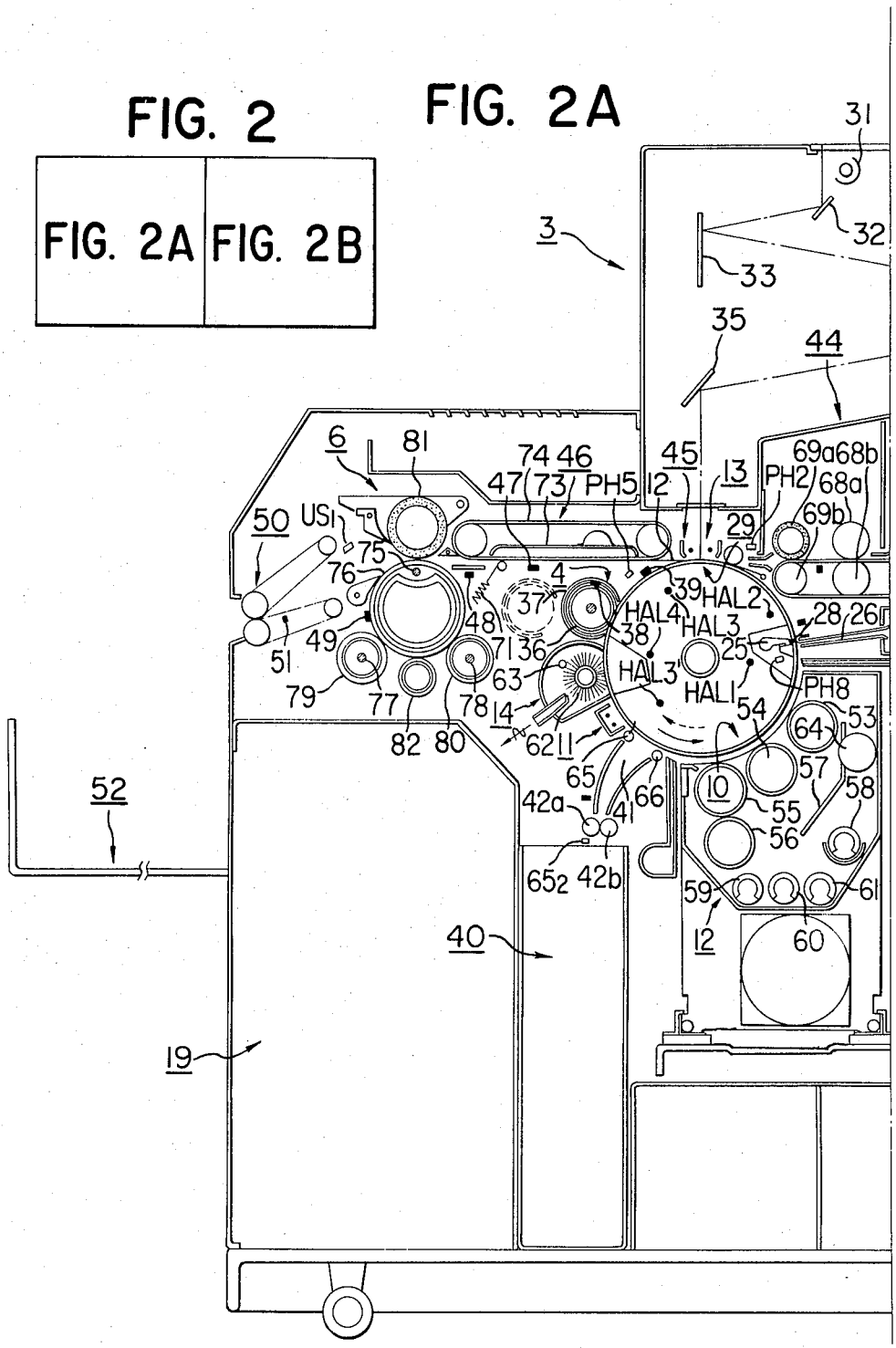
Figure 2B:
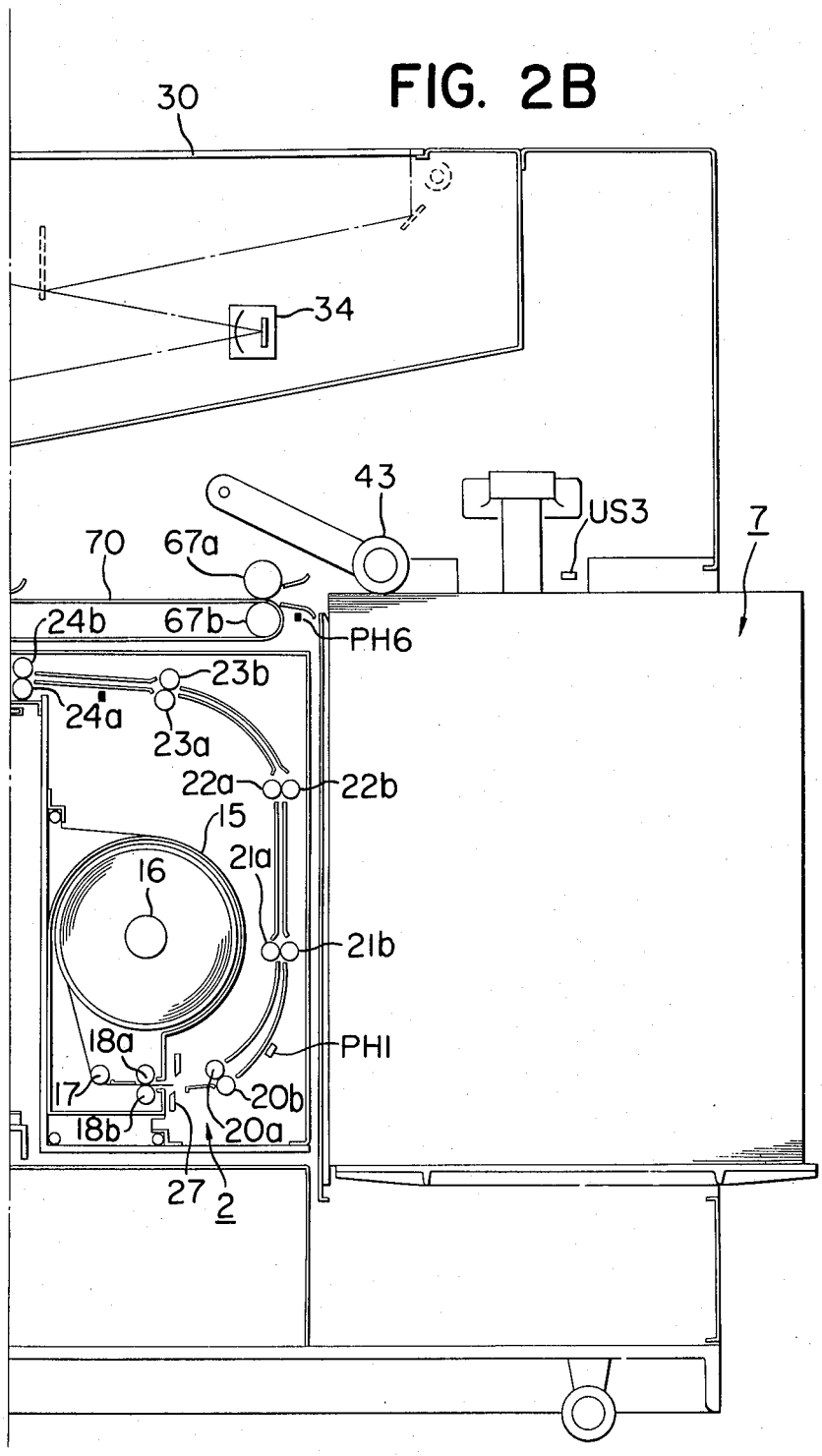

The automatic printing apparatus of FIG. 2 employs the mirror moving type slit exposure method, but the original carriage moving type slit exposure method may equally be employed and in this latter case, the exposure section may be designed more compactly if optical fiber having an image forming capability is used in the optical system. As a further alternative, the photoelectric conversion scanning exposure method utilizing laser beam or the like may be adopted, whereby processed information may be projected upon the image formation sheet.

The heat developing section 4 may comprise roller heating means 36 which may, for example, consist of a hollow metallic roller having a heater therewithin and having the surface thereof provided with a thin layer of parting agent such as silicone rubber or the like. The heat developing section 4 has, around the roller heating means 36, a heat shield plate 37 for preventing to the utmost the heat from the roller heating means 36 from escaping toward any other place than the image formation sheet, and temperature detecting means 38 for detecting the temperature of the roller heating means 36 so as to ensure the heat developing process to be achieved properly.

When it is executing the heat developing process upon the image formation sheet, the heat developing section 4 is positioned in contact with the drum 10 to follow the rotation of the drum 10, as indicated by solid line in FIG. 2, and when it is not executing its function, the heat developing section 4 is spaced apart from the drum 10, as indicated by phantom line in FIG. 2.

Alternatively, the roller heat means 36 may be of the type of roller which has a surface provided with an electrical resistance layer having a suitable resistance value and heatable upon electrical energization. Further, the heat developing section 4 is not restricted to the above-described heat transfer type heating method but may adopt the radiation heating method utilizing infrared ray generating means or the like. In such a case, the radiation generating means must be designed such that the light in the wavelength range to which the image formation sheet is sensitive is substantially little or not at all thrown upon the image formation sheet.

Where the heat developing process using the aforementioned heat transfer type heating method is adopted, the material for the drum 10 should desirably be chosen from among materials of low heat transfer coefficient in order to prevent heat from dissipating through the drum 10 to reduce the surface temperature of the roller heating means 36 and thereby preclude the image formation sheet from being sufficiently developed. Further, the drum 10 may also be constructed with an electrically conductive layer on its surface in order that the electrostatic printing process may be accomplished effectively.

Such examples of the construction of the drum 10 include a drum comprising a base member formed of hard phenol resin or polyamide resin and having its surface provided with an electrically conductive layer of low heat capacity formed of thin metal film, conductive polymer or the like, or a metallic drum having its surface covered with a layer of Teflon filled with conductive powder such as powdered copper or other material.

As has already been noted in the foregoing, the master preparation process is accomplished by the image formation sheet being wrappingly mounted on the drum 10 while, at the image forming section 29, being exposed to the image light from the original document in the exposure section 4, and by the image formation sheet being subsequently subjected to the heat developing process at the heat developing section 4. The master M prepared by the image formation sheet being subjected to the master preparation process is then in such a state that the trailing end thereof covers the opening 28 of the drum 10. By the leading end the trailing end of the master overlapping each other in this manner, there will occur an effect during the developing process at the developing section 12, to be described, that the developer is prevented from entering into the interior of the drum 10 through the opening 28 thereof and the surface of the drum 10 is prevented from being directly subjected to the charging process.

In this manner, the master preparation process is applied to the image formation sheet on the drum 10 and a master is prepared as predetermined, whereafter the electrostatic printing process is applied to the master still remaining on the drum 10.

That is, when instruction signal for the execution of the electrostatic printing process is put out from the control unit 19, respective ones of the processing sections disposed around the drum 10 are operated to execute the electrostatic printing process in accordance with a predetermined program.

In order that the electrostatic printing process may be optically executed after the master has been prepared on the drum 10, potential detecting means may detect the charge potentials of the exposed portion (the portion exposed to light) and the unexposed portion (the portion not exposed to light) in the reference region preformed at a predetermined position of the master or the charge potential only of the exposed portion, and the process conditions of one or both of the charging (secondary charging) section 11 and the developing section 12 may be controlled in accordance with the detection signal. The electrostatic printing process is executed by the processing sections disposed around the drum 10, such as the charging section 11, the developing section 12, the image transfer section 13, the cleaning section 14, etc.

The charging section 11 is a site for charging the surface of the master on the drum 10 to form an electrostatic latent image thereon and may adopt, for example, corona discharge means, roller charging means or the like.

The developing section 12 is a site for visualizing the electrostatic latent image on the master with the aid of toner dust or the like. The developing section 12 is shown as comprising three developing sleeves 53, 54, 55, a pick-up sleeve 56 underlying the developing sleeves, a dust supply screw 58 provided with a dust guide plate 57, and three stirring screws 59, 60, 61. The dust density is detected by a disc-shaped density detecting means 64. The image transfer section 13 executes the function of transferring the dust image on the master developed by the developing section 12, onto a sheet of transfer paper conveyed from the transfer paper handling section 7, and may adopt, for example, charge transfer means such as corona transfer or roller transfer.

Where charge transfer means is adopted as the image transfer section 13, it also has the function of charging the surface of the master and in such a case, therefore, the charging section 11 may be eliminated and it absence may be covered also by the image transfer section 13. More particularly, in this case, at the site of the image transfer section 13, the dust image on the master is transferred onto the transfer paper while, at the same time, the surface of the master is charged to form an electrostatic latent image, thus becoming ready to be subjected to the subsequent developing process.

The cleaning section 14 executes the function of removing any dust remaining on the surface of the master after the image transfer, and may have a fur brush 62, for example. As an alternative, the cleaning section 14 may be one having cleaning means such as cloth or blade. The dust sticking to the fur brush 62 may be shaken off by a flicker rod 63 and sucked into a suction port 70. The cleaning section 14 may be eliminated as desired.

The cleaning operation need not always be effected at all times during the rotation of the drum 10, but may be intermittently effected per complete rotation of the drum 10, or even once per 1000 complete rotations of the drum.

When the electrostatic printing process executed in accordance with the predetermined program is finished, the master on the drum 10, if it need not be subjected to a further electrostatic printing process, is separated from the drum 10 and received in a discharged master receiving section 40. The separation of the master from the drum 10 is accomplished by the drum 10 being slowly rotated in the direction (indicated by dotted arrow) opposite to the direction of rotation during the printing, in response to the signal representing the discharge of the master, so that the trailing end of the master becomes free to be guided into a master discharge port 41 by rollers 65 and 66, whereafter the master is transported toward the discharge master receiving section 40 by a pair of master discharge rollers 42*a* and 42*b*. On the other hand, the separation is accomplished with the aid of the mount-dismount means 25 being released at a point of time whereat the trailing end of the master is guided into the master discharge port 41 or at a point of time whereat the trailing end of the master is nipped between the master discharge rollers 42*a* and 42*b*.

The transfer paper is positively transported sheet after sheet from the transfer paper handling section 7 toward the image transfer site by a paper feed roller 43 and a registration section 44, in accordance with a well-timed sequence control. The registration section 44, conveyor rollers 67*a*, 67*b*, timing rollers 68*a*, 68*b*, conveyor rollers 69*a*, 69*b* and conveyor belt 70 are disposed so that the dust image formed on the master may be positively transferred onto a predetermined position of the transfer paper at the image transfer site, and these rollers and belt are adapted to be operated in a properly timed relationship with the velocity of rotation of the drum 10.

The transfer paper with the dust image transferred thereto at the image transfer section 13 is separated from the surface of the master on the drum 10 at a separating section 45, and transported to the fixing section 6 for a subsequent process.

The separating section 45 comprises a separation belt 72 having a spring 71 connected to at least one side thereof, the opposite ends of the belt being fixed.

After separated from the master at the separating section 45, the transfer paper is conveyed to the fixing section 6 by conveyor means forming a conveying section 46, in order to be subjected to the fixing process.

The conveying section 46 comprises suction conveyor means 73 and conveyor belt 74 and the transfer paper is conveyed toward the fixing section 6 by the conveyor belt 74 while the other surface of the transfer paper than the image bearing surface is being sucked. The conveyor belt 74 is designed to make contact with only the opposite ends of the transfer paper so as not to disturb the transferred image on the transfer paper.

The conveying section 46 includes jam detecting means 47 for detecting jam which may occur to transfer paper within the conveying section 46 or for detecting any delay in arrival of transfer paper, and is designed such that whenever transfer paper is jammed in the conveying section 46 or delayed in arrival, the operations concerned with the conveyance of transfer paper or all the electrostatic printing process operations are temporally stopped so as to prevent subsequent sheets of transfer paper from being conveyed from the transfer paper handling section toward the conveying section 41.

The fixing section 6 includes a rotatably mounted roller 76 having an infrared ray generating source 75 therewithin and transmissive of infrared rays, a plurality of drive rollers 79 and 80 for driving the roller 76 having therewithin heating means 77 and 78 such as heaters or the like, an rotatably mounted pressure-contact roller 81 for urging the oncoming transfer paper against the infrared ray transmitting roller 76, and a roller 82 with a parting agent applied thereto for imparting such agent to the surface of the infrared ray transmitting roller 76.

As the transfer paper subjected to the image transfer process comes to the fixing section 6, the dust image on the transfer paper is exposed to the infrared rays from within the infrared ray transmitting roller and also to the action of the transferred heat on the infrared ray transmitting roller surface because the transfer paper process between the infrared ray transmitting roller 76 and the pressure-contact roller 81 with the image bearing surface of the transfer paper facing the roller 76, whereby the dust image is semi-permanently fixed on the transfer paper. The plurality of drive rollers 79 and 80 serve to drive the infrared ray transmitting roller 76 and also to heat the surface of this roller. These drive rollers may each comprise, for example, a hollow metallic roller having a heater therewithin and having the surface thereof covered with a heat-resistant, resilient material of parting characteristic such as silicone rubber or the like.

The infrared ray transmitting roller 76 itself is not supported by a shaft but it is supported in place by the plurality of drive rollers 79, 80 and the pressure-contact roller 81.

The fixing section 6 includes jam detecting means 48 for detecting jam of transfer paper within the fixing section or delay in arrival of transfer paper. Whenever transfer paper is jammed within the fixing section 6, the predetermined pressure between the pressure-contact roller and the infrared ray transmitting roller is released while, at the same time, the switches for the heating means within the drive rollers and for the infrared ray generating source within the infrared ray transmitting roller are opened.

Control of the fixing process temperature is accomplished by the surface temperature of the infrared ray transmitting roller 76 being detected by fixing temperature detecting means 49 provided adjacent to the surface of the roller 76, and by the heating temperature of the heating means within the plurality of drive rollers 79, 80 being controlled in accordance with the detection signal.

The transfer paper with the image fixed thereon by the fixing process is conveyed into a transfer paper discharge section 52 by conveyor means 50 disposed leftwardly and downwardly of the fixing section 6. Jam detecting means 51 is provided in the conveyance path of the conveyor means 50, so that whenever transfer paper is jammed in its path from the fixing section 6 to the transfer paper discharge section 52, the detecting means serves to temporally stop the operations of some or all of the plurality of processing sections executing the electrostatic printing process.

Figure 3:
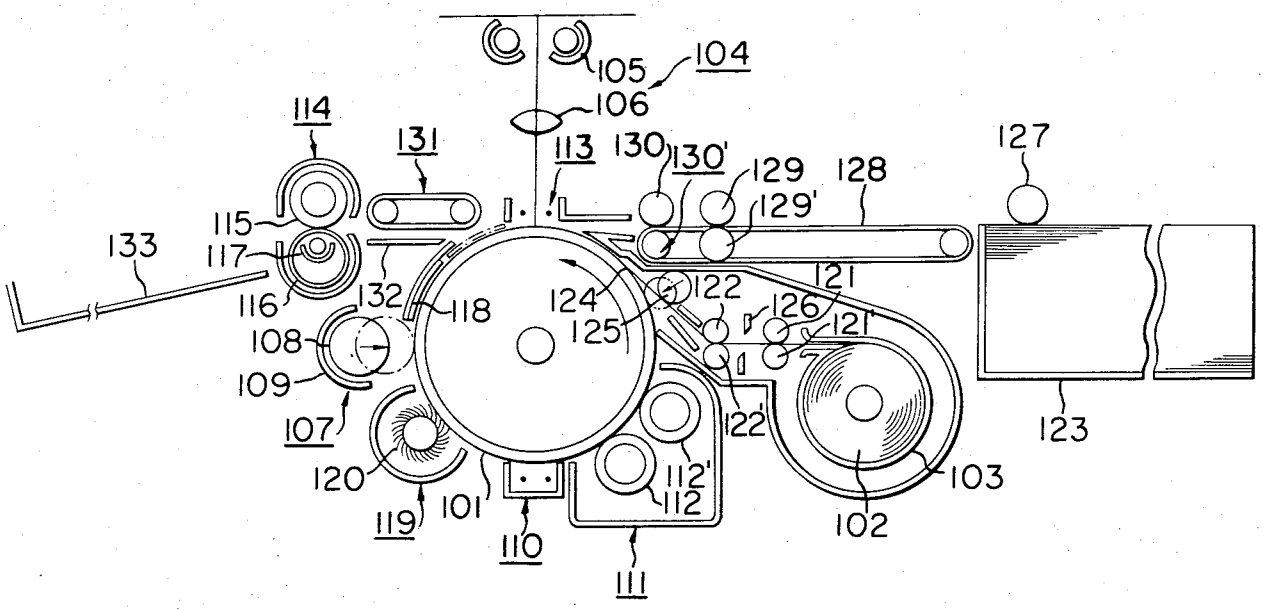
FIG. 3 is a vertical cross-sectional view of a second embodiment of the present invention.

FIG. 3 is a schematic side view of a second embodiment of the present invention.

A drum 101 is rotatably journalled and an image formation member 102 supplied from a supply spool 103 is guided to and wrappingly mounted on the outer peripheral surface of the drum 101. An optical system 104 for projecting therethrough the image light from an original onto the image formation member 102 mounted on the outer peripheral surface of the drum 101 may comprise, for example, a light source 105 and a lens 106. A heat developing device 107 for heat-developing the image formation member exposed to the image light may comprise, for example, a heat roller 108 and a heat reflecting plate 109. Alternatively, the heat developing device 107 may comprise a heater, an infrared ray lamp, a high frequency heating device or the like.

A charging device 110 for charging the surface of a master on the outer peripheral surface of the drum 101 to form an electrostatic latent image thereon may comprise a corona discharger or the like.

A developing device 111 for visualizing the electrostatic latent image on the surface of the master with the aid of toner or like dust is shown to have two sleeves 112 and 112'.

An image transfer device 113 for transferring the developed dust image on the surface of the master onto a sheet of transfer paper (printing paper) conveyed from a paper feed device 23 may comprise, for example, a charge transfer (electrostatic transfer) device such as corona transfer device or roller transfer device, or alternatively it may comprise a press roller device if the transfer paper used is pressure-sensitive tacky paper. As a further alternative, a press roll device which effects image transfer by using a pressure could be effectively utilized if the liquid developing method is used.

Where a charge transfer device is employed as the image transfer device 113, the charging device 110 may be eliminated because such image transfer device also has the function as a charging device.

A fixing device 114 for fixing the transferred dust image on the transfer paper may comprise, for example, a pressure-contact roller 115 and a heat roller 116. The heat roller 116 may comprise a cylinder transmissive of heat radiation having therewithin a heat radiation generating source 117 such as infrared ray lamp or heater. Alternatively, the heat roller 116 may be a conventional heat transfer type heating roller having a heater therewithin.

A light-intercepting plate 118 is provided which has the function of moving from a predetermined position (indicated by solid line) to a position toward the image transfer device 113 (indicated by dotted line) to thereby intercept light so that when image light is projected upon the image formation member on the drum 101 through the optical system 104, any quantity of light more than necessary may not be projected on that portion of the image formation member which has already been exposed and is moving from the exposure section toward the heat developing section.

A cleaning device 119 for removing any residual dust remaining on the surface of the master after the image transfer step may comprise a fur brush 120, for example. Alternatively, the cleaning device 119 may comprise cleaning means such as brush, cloth, blade or the like.

The operational steps of the printing apparatus of the present embodiment will now be described.

The leading end of the image formation member 102 supplied from the supply spool 103 by means of pairs of feed rollers 121, 121' and 122, 122' is secured to the surface of the drum 101 by a mounting pawl 124 attached to the drum 101. When the leading end of the image formation member 102 is secured to the drum 101, a pressure-contact roller 125 which has so far been in a predetermined position (indicated by solid line) is moved in the direction of arrow (to a position indicated by dotted line) to urge the image information member 102 against the outer peripheral surface of the drum 101, whereby the image formation member 102 is brought into intimate contact with the other peripheral surface of the drum 101.

The image formation member 102 is cut to a necessary length by a cutter 126, and the cut end of the image formation member is also secured to the drum 101 by a pawl or the like. With the rotation of the drum 101 in the direction of arrow, the image formation member 102 passes through the exposure station where it is irradiated with the image light from an original.

A latent image is formed on the exposed portion of the photosensitive layer on the back-up member in that portion of the image formation member 102 which has been irradiated with the image light.

Subsequently, the latent image on the image formation member is heat-developed by the heat developing device 107, whereupon silver is deposited to form a silver image on the image formation member 102. Little or no deposition of silver is seen on the unexposed portion of the image formation member. In the manner as described above, a master for printing is made from the image formation member.

The most conspicuous feature of the master for electrostatic printing so formed would be that the surface thereof is smooth, instead of being concavo-convex as was the surface of the conventional master. Such master is therefore excellent in that the image therein is not injured by mechanical friction during the printing. Also, the image formed on the master consists of an aggregate of silver particles which has a very rare high resolving power, and this, coupled with the smoothness of the surface, leads to a very high fidelity of the formed electrostatic image with respect to the original image and thus, the resultant print has a quality of image quite faithful to the original image.

The formed master is charged by the charging device 110 such as corona discharger or the like so that the region of the surface thereof which is free of the silver image is charged with negative charge. The corona discharger may be replaced by a positive corona discharger or an AC corona discharger or even a contact charger.

As the result, electrostatic charge selectively rids on the master to form an electrostatic image (electrostatic pattern).

The electrostatic image is developed by the developing device 111. The development of the electrostatic image is accomplished by any of conventionally used methods such as cascade development, magnetic brush development, liquid development, magne-dry development, water development, etc., as the result of which the electrostatic image is transformed into a dust image such as toner image or the like. If the toner particles are not particularly endowed with charge or if the toner particles are endowed with charge of the opposite polarity to the charge of the electrostatic image, the toner particles will stick to the portion of the master which has been endowed with the electrostatic charge. On the other hand, if the toner particles are endowed with charge of the same polarity as the electrostatic charge, the toner particles will stick to the portion of the master which has not been endowed with the electrostatic charge.

Subsequently, transfer paper 44 is brought into contact with the surface of the toner image so that the toner image is transferred to the transfer paper by the use of a corona transfer charger opposite is polarity to the charge of the toner particles which imparts the charge from the back of the transfer paper. The toner image so transferred is fixed by the fixing device 114.

The fixation is usually accomplished by the heat fixation, the solvent fixation or the like. Where the liquid development is employed, the fixation may be done simply by drying the toner image. Alternatively, pressure fixation may be adopted.

Next, the surface of the master is cleaned by the cleaning device 119 to remove any residual toner thereon. The cleaning may be done by the use of cleaning means such as brush, fur brush, cloth, blade or the like. The cleaning of the surface of the master may be carried out only if required, and need not always be effected.

A supply of transfer paper is contained within a conventional paper supply device 123 and when required, a sheet of transfer paper is fed by means of a paper feed roller 127 and a conveyor belt 128 and stays at rest on the conveyor belt 128 with its leading end positioned at a pair of timing rollers 129 and 129' until the image transfer takes place. The rotational movement of the timing rollers 129, 129' is timed with the movement of the master developed by the developing device 111 which comes to the image transfer site for the transfer of the dust image thereon in accordance with the rotation of the drum. At a point of time whereat the timing is obtained during the image transfer, the timing roller 129 starts rotating and cooperates with a pair of register rollers 130 and 130' to move the transfer paper to the image transfer site.

The transfer paper with the dust image transferred thereto is separated from the surface of the master by a separating device 131 and guided on a guide plate 132 and passed through the fixing device 114 into a tray 133 for temporal storage therein.

The printing process is carried out by repeating the steps of charging, development, image transfer and fixation, except in the master preparation process which comprises the steps of exposing the image formation member to image light and heat-developing the image formation member, or if the charge transfer (electrostatic transfer) step is adopted as the image transfer step, by repeating the steps of development, image transfer and fixation after the steps of charging, development, image transfer and fixation have been effected. In the latter case, the cleaning step is added as required. Cleaning of the surface of the master is not necessary where the so-called electrostatic image transfer step is adopted which is the step of transferring the electrostatic image formed on the surface of the master onto an insulative transfer member.

Where the electrostatic image transfer step is adopted, the printing process is carried out by repeating the steps of charging, electrostatic image transfer, development and fixation (the case that a print image is to be directly provided on the image transfer member), or by repeating the steps of charging, electrostatic image transfer, development, image transfer and fixation and if required, the cleaning step to remove the residual dust on the surface of the image transfer member (the case that the electrostatic image is once transferred to the aforementioned image transfer member and developed, whereafter the dust image resulting from the development is in turn transferred to another transfer member such as transfer paper or the like).

A heat-developable photosensitive material has been used as the image formation member to form a master, whereas if the formed master is separated from the surface of the drum without being subjected to the subsequent printing process, the image formation member may be used as a copy sheet and thus, the printing apparatus of the present invention may also serve as a copying apparatus and has a wide range of performance from production of a single copy to high-speed printing of multiple sheets. Where a copy sheet such as sheet of zinc oxide is employed as the image formation member, the surface thereof may be uniformly charged by the charging device 110, exposed to image light through the optical system 104 (set so as to provide a positive image), and developed by the developing device 111, whereafter the resultant dust image on the copy sheet may be fixed in the fixing device 114 by the copy sheet being separated from the drum 101. Alternatively, the dust image on the copy sheet resulting from the development by the developing device 111 may remain on the drum 101 and be developed thereon by the heat developing device 107, whereafter the copy sheet may be separated from the drum.

Figure 4:
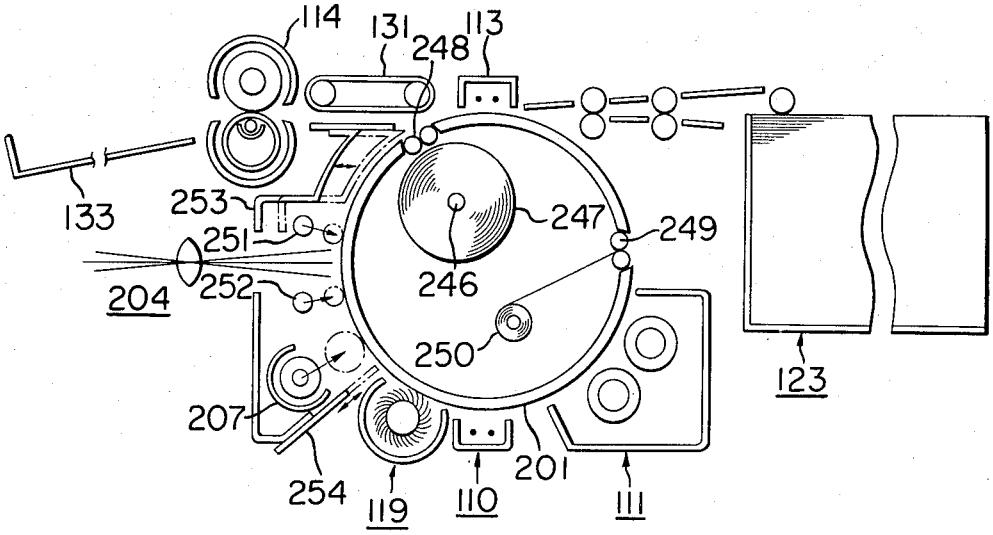
FIG. 4 is a vertical cross-sectional view of a third embodiment of the present invention.

FIG. 4 is a schematic side view generally showing a third embodiment of the present invention.

The printing apparatus of FIG. 4 is constructed such that the image formation member is supplied from within a drum 201. More particularly, the leading end of the long-footage image formation member 247 rolled on a reel 246 within the drum is led outwardly of the drum 201 through an opening in the other peripheral surface of the drum by a pair of feed rollers 248, and guided along the round surface of the drum 201 and now led back into the drum 201 through another opening in the outer peripheral surface of the drum by a pair of feed rollers 249, and then attached to a reel 250. In this manner, the preparation for the master preparation process is accomplished. Exposure of the image formation member 247 to image light is effected through an optical system 204 while, at the same time, rollers 251 and 252 are moved toward the drum 201 (in the direction of arrow) and into pressure contact with the drum 201 so as to bring the image formation member into intimate contact with the outer peripheral surface of the drum 201, and light-intercepting plates 253 and 254 are also moved to their dotted-line positions so that any other surface portion of the image formation member than the surface portion to be exposed may not be exposed to light. The exposed portion of the image formation member is heat-developed by a heat developing device 207, whereafter the image formation member is subjected to the printing process as described in connection with FIG. 3. When the printing process is applied to a master, it is necessary to move the rollers 251, 252 and the light-intercepting plates 253, 254 away from the drum 201 back to their original positions.

Description will now be made of the structure of heat-developable photosensitive material which is the most effective photosensitive material (image formation member) usable with the printing apparatus of the present invention because of its simplicity.

Heat-developable photosensitive material is provided usually by mixing and dispersing organic silver salt (a) and halide (b) into a binder which is an insulative medium, applying the mixture onto a suitable back-up member to form a layer of organic silver salt (photosensitive salt), subsequently mixing a reducing agent (c) with a resin such as cellulose acetate or the like by the use of a suitable solvent, and applying this mixture to the surface of the organic silver salt layer to provide a layer of reducing agent.

Among the above-mentioned components, the reducing agent (c) may be contained in the organic silver salt layer, or the reducing agent (c) contained in the organic silver salt layer may further be applied to the surface of said layer in the manner as described above.

Alternatively, the above-mentioned components may individually be separated into discrete layers.

Figure 5:
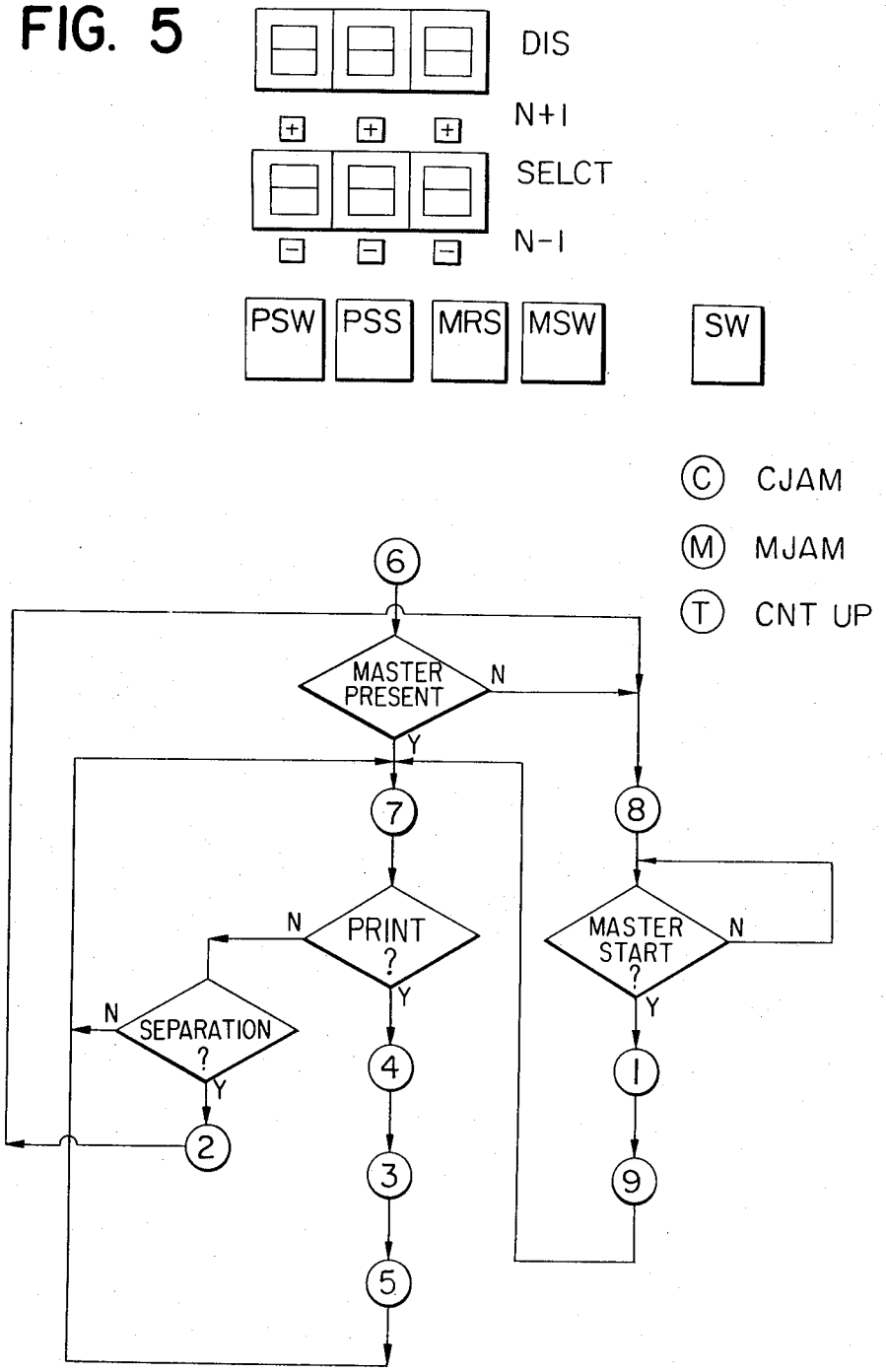
FIG. 5 is a plan view of the operating section of the apparatus according to the present invention.

The sequence control in the present invention will now be discussed. FIG. 5 shows the operating panel in the printing apparatus of the present invention, and it is located at 11 in FIG. 1. The operating panel includes a main switch SW, a master preparation switch MSW, a print start switch PSW, a print stop switch PSS, a master discharge switch MRS, a mechanical type 3-digit figure selector SELCT which may effect +1 by closing of N+1 buttons and −1 by closing of N−1 buttons, and a 7-segment 3-digit display device. Designated by ① -⑨ are display means comprising light-emitting diodes for displaying the lapse of the process sequence. CJ, MJ and CT denote display means (light-emitting diodes) for displaying copy paper jam, image formation member (master) jam and copy count lap, respectively.

A photelectric switch PH comprises a lamp and a light receiving element, and is designed such that interception of the lamp light by an image formation member or a copy sheet is detected by the light receiving element. An ultrasonic switch US comprises an ultrasonic oscillator and an ultrasonic microphone, and is designed such that interception of ultrasonic wave by a copy sheet is detected by the reception element. A magnetic switch HAL comprises Hall elements located at positions HAL1 to HAL4 in the main body, and a magnet provided so as to cross each element with rotation of the drum.

Such control will hereinafter be described with respect to an example of the control carried out by a circuit using a 4-bit parallel process CPU 4040, manufactured by INTEL, Inc., and based on the computer system MCS-4. PROM designates a programmable read-only memory which stores the control flows of FIGS. 9-*a* to 9-*f* in the form of codes (instructions, data) successively in order from zero address. RAM is a read-and-write memory which temporally stores the data during execution of the said flows. #0–#9 at the input side are input ports for entering information necessary for the control, and each comprise a gate circuit which takes in input data under AND condition with port select signal. Respective ones of the aforesaid objects to be detected are connected to the four bits of each of these input ports. #0–#9 at the output side are output ports for operatively controlling the objects to be controlled (loads) and each comprise a latch circuit operable by port select signal. Respective ones of the objects to be controlled are connected through amplifiers to the four bits of each of these output ports.

Figure 8A:
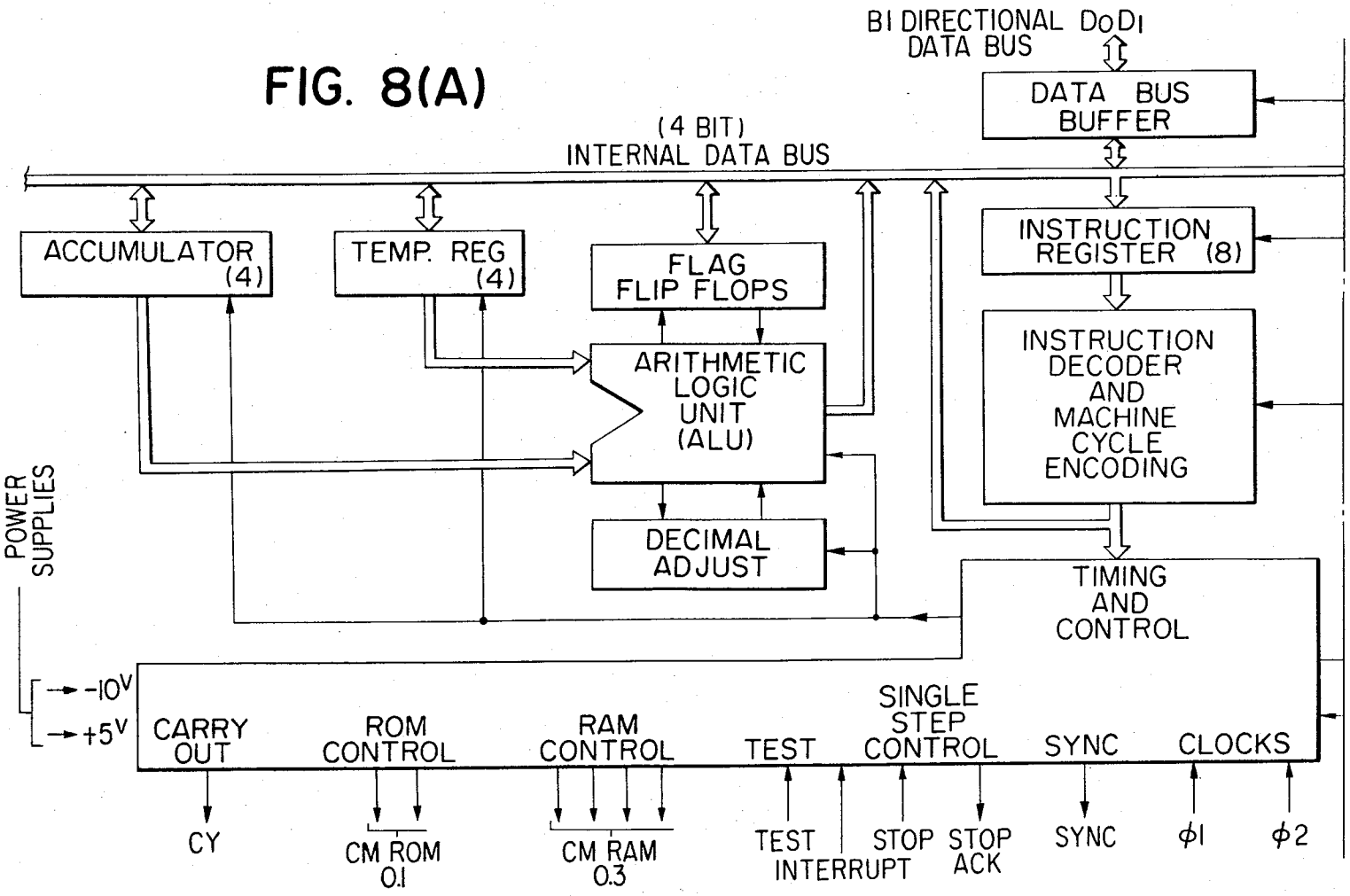
FIG. 8 is a block diagram of the CPU, wherein FIGS. 8(A) and 8(B) ae combined along the broken lines thereof to form a single view.
Figures 8, 8A, 8B:
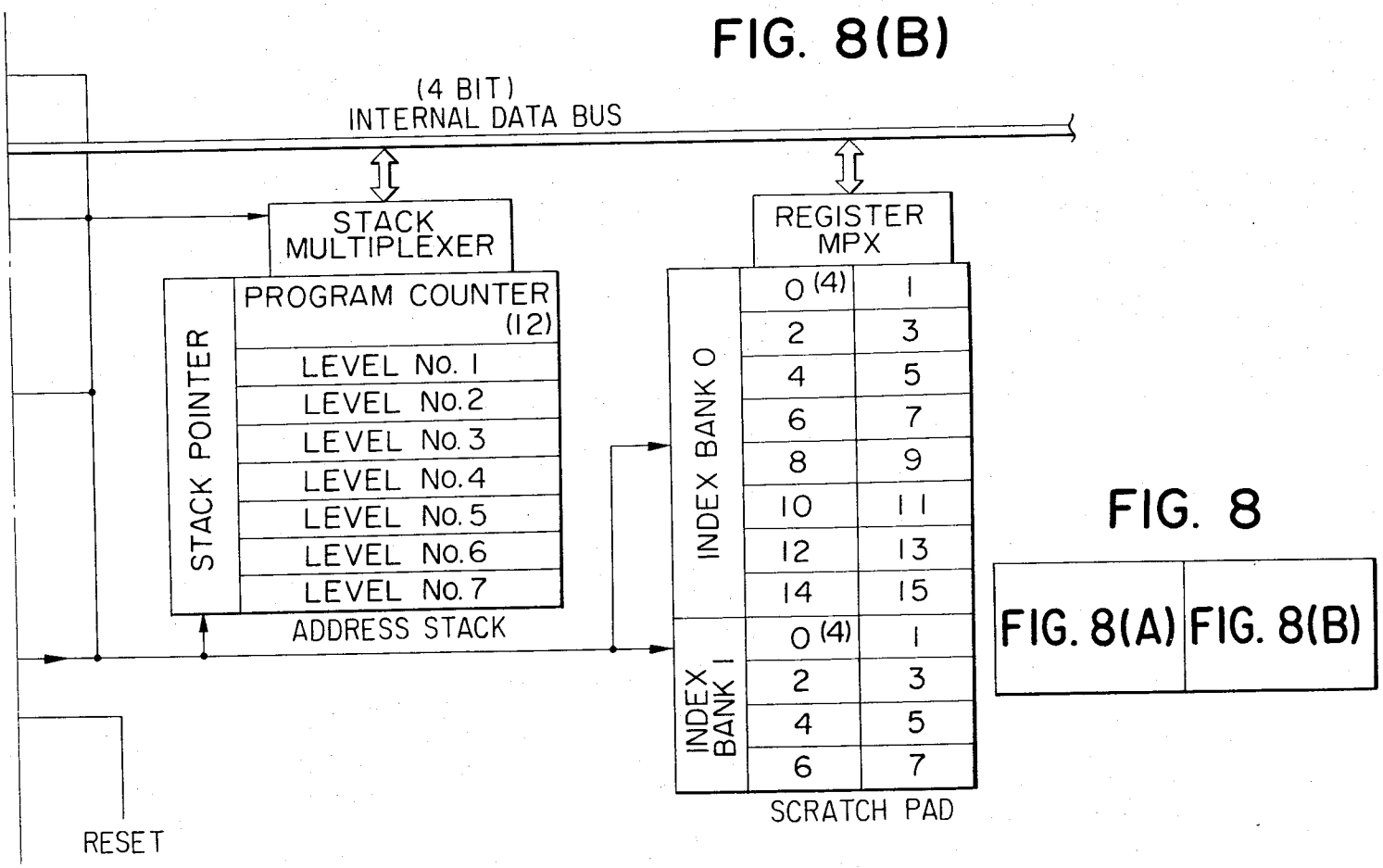

The CPU is a processor which is described in detailed in Manual MCS-4 (FIG. 8). A memory interface is provided for the selection of the input and output ports and for the designation of the addresses of PROM. A decoder comprises a 4- to 16-bit converter for selecting the input and the output ports #0–#9. A buffer comprises a memory for temporally storing the data from the input ports or the data to the output ports.

As is well-known, the CPU is such that clock pulses $\phi$ provided by closing of the main switch are entered and the clock pulses are counted by a program counter (FIG. 8) and upon a predetermined number of clock pulses, address data for designating the zero address of ROM is put out from $D_0$–$D_3$, so that the instruction stored at the zero address of ROM is introduced through the interface into the CPU, in which the instruction is decoded by an instruction decoder, whereby output data or address data is formed in the accumulator Acc or the register IR of the CPU, or the address data in the register IR is put out from $D_0$–$D_3$ in succession and passed through the interface to designate or select an input or an output port by the most significant four bits, or the output data is put out from the selected port or the input data is entered through the selected port.

In the present example, the RAM used is 4002, the interface used is 4289, the PROM used is 1702A, the decoder used is 3205, the buffer used is DM8093, the gate used is 8234, and the latch used is 3404.

Figure 7A:
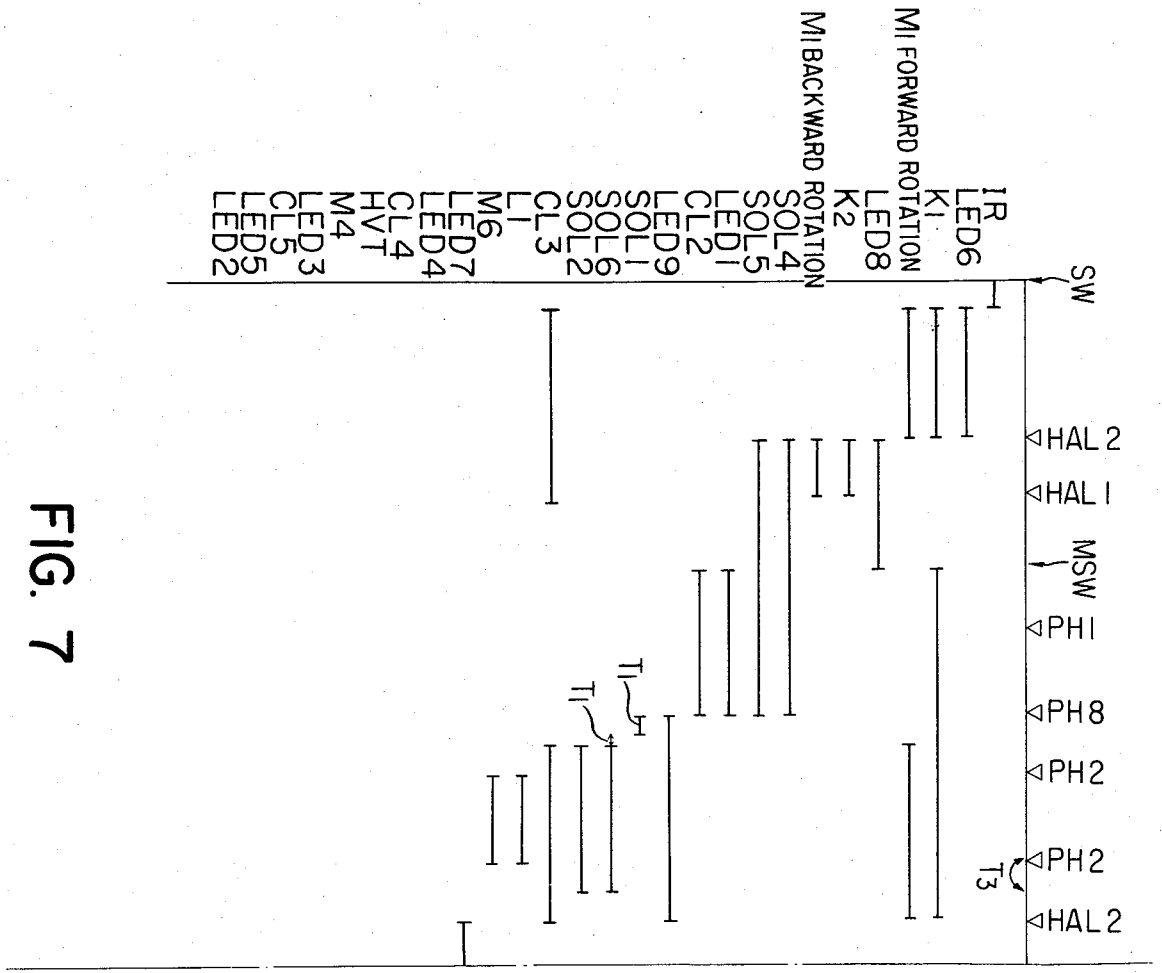
FIGS. 7(A) and 7(B) are combined along the broken lines thereof to form a single view.
Figure 7:
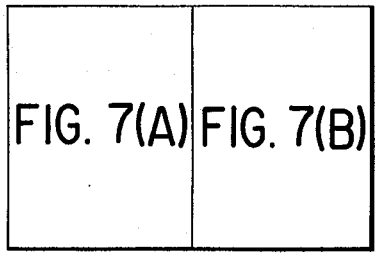
Figure 7B:
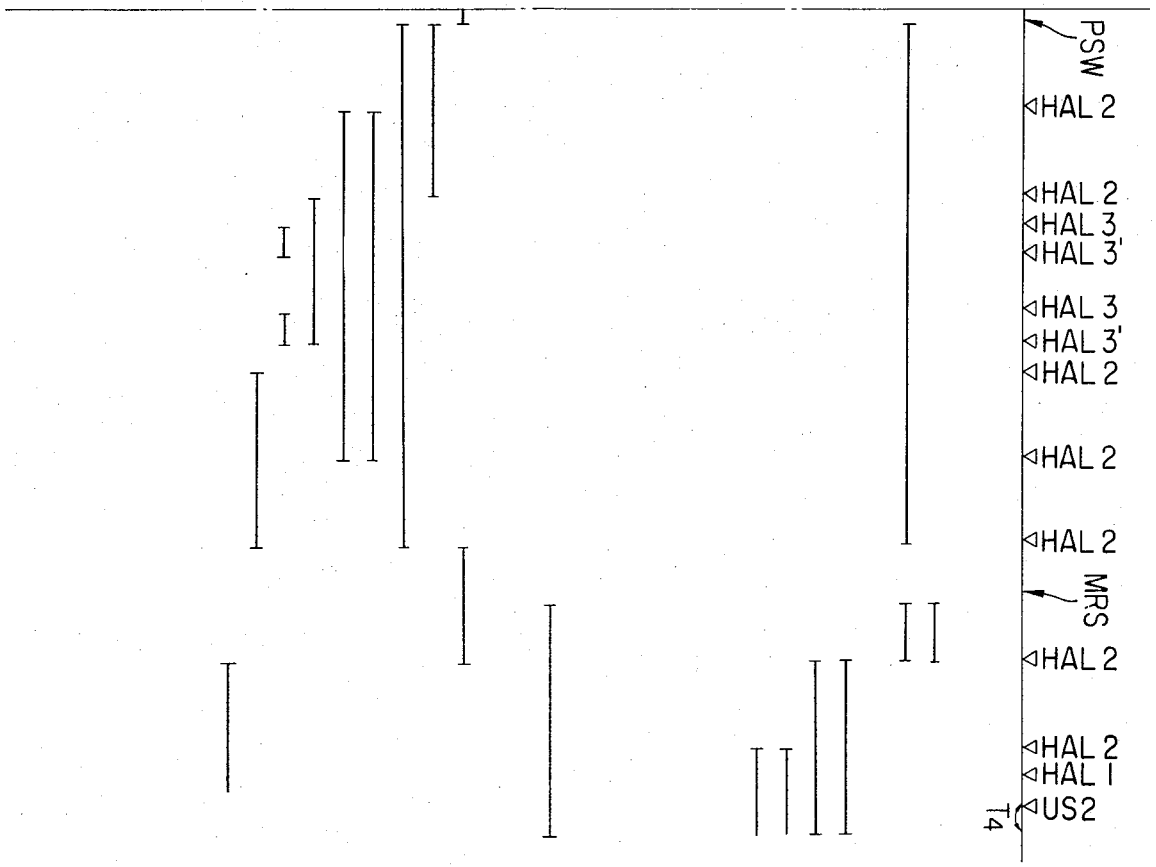

Detailed procedures of the control will hereinafter be described by reference to the time chart of FIG. 7, the flow charts of FIG. 9 and the circuit diagram of FIG. 6.

First, the main switch SW is closed to operate drum motor M2, heat developing heaters H1, H2 and fixing heaters H4, H5, H6 and generate clock pulse for running the CPU.

Reset

The CPU reads the zero address of ROM, decodes the instruction code, designates (selects) the output ports #0–#0 in succession, puts out output data (0000) and resets the output ports #0–#9.

In a time $T_1$ after that, the CPU reads the input port #5 and checks whether or not the initial reset signal IR has become from H-level to L-level (this will further be described). The signal IR is one which maintains high level when the transient phenomenon during the closing of the main switch becomes stable, and which may be provided by the charging signal of an external capacitor.

Master Check

After the L-level of the reset signal IR is detected, the sequence proceeds to the check routine of detecting whether the master has been mounted on the drum.

First, display device LED6 for displaying the check routine is turned on, relay K1 and clutch CL3 are energized to operate the drum motor M1 to rotate the drum is forward direction (indicated by arrow in FIG. 2). The drum makes three full rotations and print positions HAL2 is detected three times, whereupon relay K1 is deenergized to stop the motor M1 and turn off LED6. The input port of the master detector PH5 is read to check whether PH5 is at H-level. Since the master has a black check zone for the master detection, it can be discriminated from the white of the drum surface. When the presence of the master is detected, LED7 is turned on and then, the sequence shifts to the discrimination of whether print button or separation button has been depressed (in the flow, the sequence jumps to the step A001).

If the absence of the master is detected, LED8 is turned on and relay K2 is energized to reverse the rotation of motor M1 and start moving the drum from print position HAL2 to grip position HAL1. Further, solenoid SOL4 for opening the gripper and solenoid SOL5 for causing a drum-fixing pin to strike against the drum are energized. The sequence proceeds to the routine of checking whether the gripper has come to the grip position HAL1. That is, when the drum has rotated to the grip position, the pin comes into the already opened gripper to fix the drum. Relay K2 and clutch CL3 are deenergized.

Next, the sequence proceeds to the routine of checking whether the heat developing device has reached a predetermined temperature. By an input signal ($DUP_0$=H) to the input port #8 which results from the detection of that temperature, the sequence proceeds to the routine of reading input port #3 connected to switch MSW.

Master Mount Sequence

When the input signal to input port #3 which results from the closing of master switch MSW is detected, LED is turned off and LED1 for displaying the master preparation sequence is turned on. Clutch CL2 is energized to drive the feed roller 17 to start feeding an image formation member. Subsequently, in a time $T_2$ after that, input port #4 is read to check whether the image formation member has reached detector PH1. If the feeding has been effected properly, the image formation member should be present at Ph1 in the time $T_2$ and therefore, if the image formation member is not detected, the sequence shifts to the master jam treatment (in the flow, the sequence jumps to the step MJAM).

After PH1 detects H-level, input port #7 of master detector PH8 provided adjacent to the gripper of the drum is designated to check arrival of the image formation member. When PH8 is at H-level, solenoids SOL4 and SOL5 are turned off and the drum gripper grips the image formation member with the aid of the force of the gripper spring, thus rendering the drum rotatable. LED1 is turned off, LED9 is turned on, clutch CL2 is deenergized to stop conveyance of the image formation member, and solenoid SOL1 is energized to operate the cutter to cut the image formation member.

Master Preparation Sequence

In a time $T_1$ after, solenoid SOL1 is deenergized and an additional time $T_1$ after, solenoid SOL6 is energized to urge the pressure-contact roller against the drum, solenoid SOL2 is energized to urge the heat developing roller against the drum, clutch CL3 is energized to rotate the drum in forward direction and the image formation member is mounted on the drum. With the rotation of the drum, the image formation member is detected by detector PH2 (H-level), whereupon lamp L1 is turned on and motor M6 is driven to move the exposure optical system to effect slit exposure scanning, whereby the image formation member is exposed to the image light from the original. Subsequently, the image formation member is heat-developed by the heat developing roller and this image formation member provides a master. The drum makes one full rotation and the master thereon is detected by PH2, whereupon PH2 assumes L-level. Lamp L1 is turned off and motor M6 is deenergized to return the optical system to its original position. In a time $T_3$ after that, solenoid SOL2 is deenergized to separate the heat developing roller from the drum. Solenoid SOL6 is deenergized to separate the pressure-contact roller from the drum. Thereafter, arrival of the drum at the print position is checked and when detector HAL2 is at H-level, master check is again effected by detector PH5. When PH5 is at H-level, relay K1 is deenergized to stop the motor and accordingly the drum, and then the sequence proceeds to the subsequent print preparation step. When this occurs, display device LED9 is turned off while display device LED7 is turned on. Print Sequence Input ports #0–#2 are read and a three-digit number of print sheets is stored in RAM. At the same time, this is displayed through output ports #0–#2. Next, whether the output WVP from the temperature detection element of the fixing device is at H-level representative of a predetermined temperature is checked. If it is at H-level, presence of copy sheet on the tray is confirmed by detector US3 (CPO=H) and in addition, whether the print switch PSW has been closed (H) is checked. When WVP and CPO are at L-level, the print is not started even if switch PSW is depressed. Even if the conditions are satisfied, depression of the master separation switch MRS will cause shift to the separation sequence (step A002). When neither of PSW and MRS is depressed, reading of the set number of copy sheets, temperature check and paper check are again effected.

When switch PSW is closed (H-level), LED7 is turned off and LED4 is turned on to display that the pre-rotation mode has been entered. Clutch CL4 is energized to connect the drum from motor M1 to high-speed motor M2. The drum makes one full rotation and rotation of the drum to print position HAL2 is detected, whereupon high voltage source HVT connected to each charger is energized to operate developing motor M4 which stirs the toner. The drum effects a further full rotation, whereupon LED4 is turned off and LED3 is turned on to display that the print mode has been entered. Next, display device DIS displays "0" to indicate the number of copy sheets. This is accomplished by causing "0" to be stored in index registers IR4-6 within the CPU and put out from output ports #0–#2.

When the paper feed position HAL3 on the drum is detected, the paper feed clutch CL5 is energized to lower the forwardly rotating feed roller 48 to feed a copy sheet to the drum. Upon detection of the drum position HAL3', clutch CL5 is deenergized. In the meantime, the copy sheet has been fed to paper detector PH6 by register rollers 73 and 74. If PH6 is then at L-level, the step of copy sheet jam treating routine CJAM is entered. If PH6 is at H-level, PH5 checks whether the master has been separated from the drum and when PH5 is at L-level, the step of master jam treating routine MJAM is entered.

When in normal situation, registers IR4-6 advance by 1 and memorize that a sheet of copy paper has been fed. The contents of the registers IR4-6 are put out from output ports #0–#2 to display 00. The dial set value entered into input ports #0–#2 is read into the accumulator Acc within the CPU, and that value is compared with the value stored in registers IRO-2 as to whether they are coincident.

If the two values are coincident, the paper feed is terminated and the print terminal mode is entered. If the two values are not coincident, whether stop button PSS has been depressed in the operating section is checked and if PSS is at H-level, the print termination mode is also entered. Even if PSS is at L-level but if no paper is present on the copy paper table (CPO=L) and the fixing temperature is low (WVP=L), the termination mode is also entered. If no count-up is effected and the above-mentioned conditions are sufficient, the routine of reading the paper feed timing (check of HAL3) is again entered.

Stop button PSS, when depressed, holds it.

Print Termination Sequence

At this stage. LED3 is turned off and LED5 is turned on to display the termination mode. The drum continues to make one full rotation and at the print position HAL2 thereof, the high voltage transformer HVT and the developing motor M4 are deenergized. The drum makes a further full rotation and at the same position HAL2 thereof, clutch CL4 is deenergized to stop rotation of the drum.

Thereafter, LED5 is turned off and LED7 is turned on to display "print possible", whereupon the aforementioned print mode (step A001) is entered.

Separation Sequence

In the print mode, separation button is depressed (MRS=H) and the step of separation routine A002 is entered.

Relay K1 is energized to operate motor M1 and the drum makes one full rotation. When the drum print position HAL2 is detected, relay K1 is deenergized to stop the drum and relay K2 is energized to start backward rotation of the drum. LED7 is turned off and LED2 is turned on to display the separation mode.

When the drum reaches the print position HAL2 after one full backward rotation, solenoids SOL4 and SOL5 are energized to null the gripping force of the gripper and actuate the pin. By this backward rotation of the drum, the tail of the master enters the discharge port and the master is separated. When the drum reaches the drum grip position HAL1, the pin comes into the drum to open the gripper and the master is discharged from the drum by discharge roller.

Upon detection of the position HAL1, relay K2 is deenergized to stop rotation of the drum and detector PH5 checks whether the master is still present on the drum. If PH5 is at H-level, the master jam routine MJAM is entered.

Further, separation of the master is checked by master detector US2 provided at the master discharge port and if US2 is at L-level, the routine MJAM is also entered.

When exact discharge of the copy sheet is detected, relay K2 is deenergized in a time T4 thereafter and the master preparation step A002 is entered, whereby the apparatus becomes ready to operate for the preparation of another master.

Copy Sheet Conveyance

Figure 10:
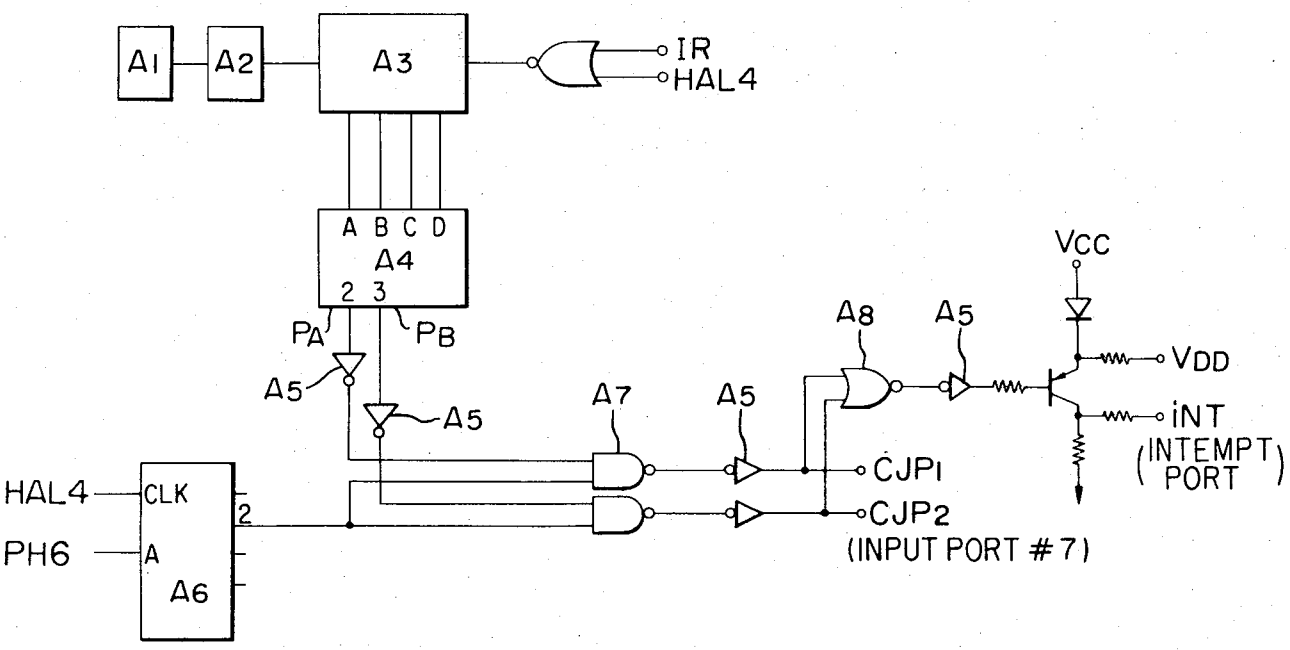
FIG. 10 is a diagram of the jam check circuit.
Figure 11:
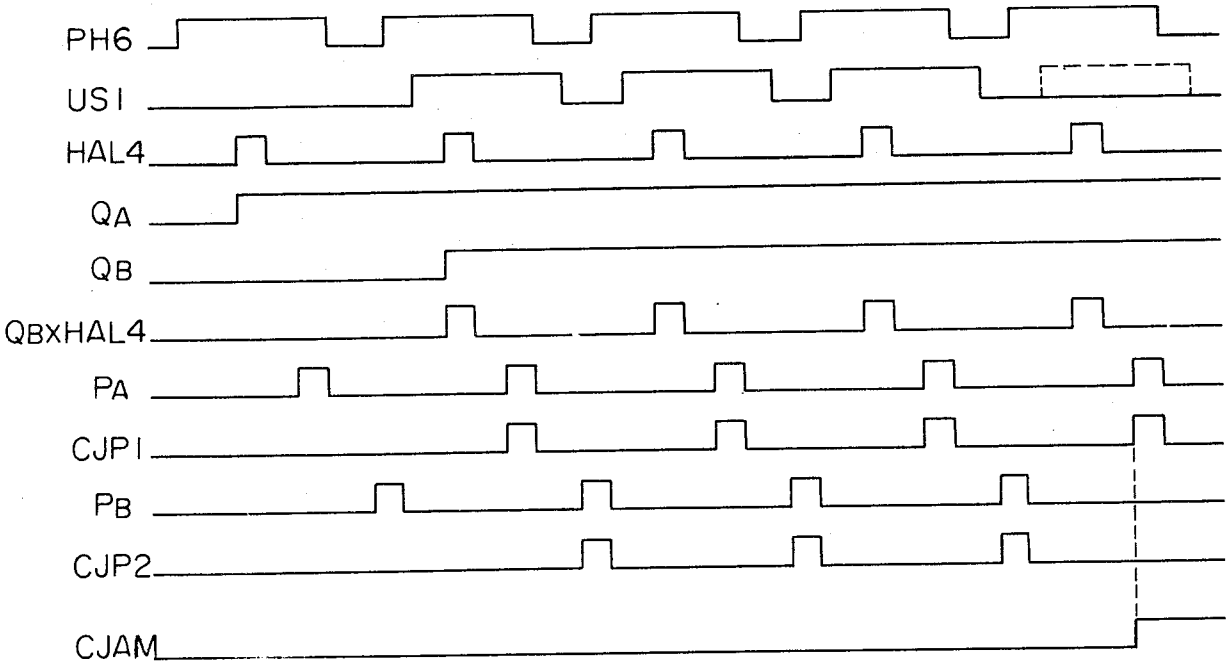
FIG. 11 is a time chart for the circuit of FIG. 10.

After having been fed, the copy sheet is conveyed to the image transfer section while being timed for image transfer by register rollers mechanically coupled to the drum. The copy sheet is checked as to its jam by check pulses CJP1 and CJP2. FIG. 10 shows, in block diagram, the circuit for forming the check pulse and applying it to the interrupt terminal iNT and the input port #7 of the CPU. When pulse CJP1 is put out and the terminal iNT assumes H-level, the contents of carry flag FF in the accumulator Acc of the CPU are saved in the RAM and accordingly, the present address of the program counter is saved in an attack pointer. Then, jam or no jam is determined by reading the address of ROM which stores the routine of determining whether the CJP1 terminal of the input port #7 is at H-level and the routine of determining whether the discharge detector US1 has detected the paper. If US1 is then at L-level, the routine of CJAM is entered. In case of the interrupt input resulting from the H-level of CJP2, if US1 is at H-level, the copy sheet being stationary on the detector is determined and the routine of CJAM is entered. Normal conveyance of the paper is determined and by the instruction "return to main program", the saved contents in said address and Acc are called back to execute the main program. In FIG. 10, there is seen an oscillator A1, a frequency divider A2, a counter A3, a decoder A4, an inverter A5, a shift register A6, a NAND gate A7 and a NOR gate A8. FIG. 11 is a time chart for illustrating the operation of the FIG. 10 circuit. That is, when HAL4 is detected for the second time, check pulses CJP1 and CJP2 are generated. The frequency divider A2 is so set as to generate sixteen pulses for movement of the length of the paper.

MJAM Step

Output ports #3–#9 are designated and the bits of all these ports are cleared. The LED for displaying MJAM is turned on to bring the apparatus to halt (HLT).

CJAM Step

As in the MJAM step, output ports #3–#9 are all cleared and the LED for displaying CJAM is turned on and further, output port #4 is designated to energize SOL3 and release the pressure of the fixing roller, thereby bringing the apparatus to halt (HLT). The release from the halt condition is accomplished by opening the main switch SW.

The program codes for the above-described control may be obtained from Manual MOS-4 and the flow charts of FIG. 9.

Reset and master check sequence will be described in accordance with the program code list. In Step B001, CPU reads LDMO and decoder ID decodes it, whereupon (0000) is set in the accumulator Acc. Next, FiM 0,0 is decoded, whereupon 0000 and 0000 are set in the pair 0,1 of the index register IR in SCRATCH PAD memory. When SRC 0 is read, the port for the contents of IRO, namely, the port #0, is designated and when WRR is read, (0000) of Acc is put out at the output port #0. When iSZ is read, +1 is effected on IRO to bring about 0001 and SRC is again read to designate port #1. By WRR, the (0000) in Acc is put out at output port #1. This routine is repeated until IRO becomes 0 (0 is obtained after +1 is effected sixteen times), whereupon output ports #0–#9 are reset.

Subsequently, JMST1 is read and decoded, whereupon the address of the present step is stored at the top of STACK POINTER (SP) and the subroutine of timer T1 is entered. After the subroutine is terminated, +1 is effected on SP and the routine of B004 comes back.

Likewise, FiMO,5 is read, whereupon 5,0 is set in IR. When SRCO is read, input port #5 for IR is designated, RDR is read, whereby the data of #5, namely, WUP, PSS, PSW and IRS, are set in Acc. Next, RAR is read, whereupon the contents of this Acc is rotated rightwardly by 1 bit. That is, the contents of the carry (CY) resulting from such rotation is set into the flag flip-flop through the operator ACU. Since the initial set signal corresponds to the fourth bit, 1 is produced in FF by the rightward rotation upon arrival of the reset signal. When JC is read, whether 1 is produced in the FF is checked. If FF is 0 (CY+0), namely, when the reset signal has extinguished, the next step is entered. If FF is 1, the steps from FiMO,5 are repeated.

Subsequently, 0010 is stored in Acc by LOM2, 7,0 is stored in IR by FiM0,7 output port #7 is designated by SRC, the contents of Acc is put out by WRR, and 1 is put out at two bits of output port #7 to turn on check mode display device LED6.

Next, D(=14) is stored at 'E' address of IR by FiMX'E', 'DO'. In the same manner as already described, the subroutine of energizing relay K1 to rotate motor M1 in forward direction and detecting the print position HAL2 is entered (PPOS), whereby the drum effects two full leftward rotations. In accordance with instruction JNC, presence or absence of carry is checked and 1 at the second bit is discriminated and, when 1 is detected, +1 is effected on the contents of the 'E' address of register IR in accordance with instruction iSZ, and the routine of PROS is repeated until said contents equal 17. When 17, namely, 0 in code, is reached, the routine of B006 is entered, that is, the drum effects three full rotations and the sequence proceeds to the step of relay K1, LED6 OFF. Thereafter, the subroutine of reading PH5 is entered and the rotation corresponding to the contents of Acc is effected as already described and, when carry is detected in accordance with instruction JC, LED7 is turned on, whereupon print routine A001 is entered.

When non-carry, namely, absence of the master on the drum is detected, the step of LED8, relay K2 ON is entered and the drum is rotated in backward direction.

Further, (0011) is stored into Acc in accordance with instruction LDMX'C', and the contents of Acc are put out at output port #4 in accordance with FiMO,4 to turn on SOL4 and SOL5, thus preparing for the mounting of the master. After the subroutine of detecting grip position HAL1 has been executed, the next master preparation routine A003 is entered.

Table 3 shows the subroutine PROS. Tables 4 and 5 show the code lists for the mounting of image formation member, master formation and master separation. The remaining flow can be accomplished by modification of the above-described example of program and need not be described further.

Figure 12A:
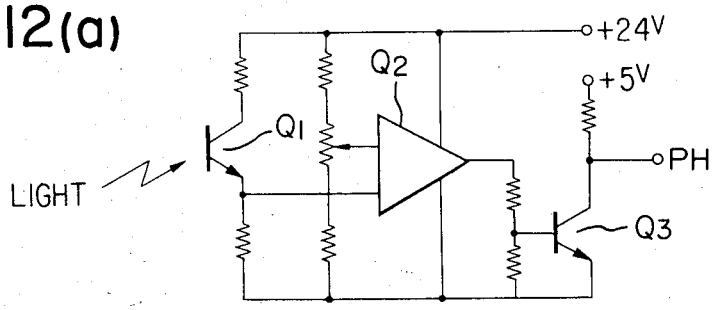
FIGS. 12*a*–12*c* diagrammatically show examples of the detection circuit.
Figure 12B:
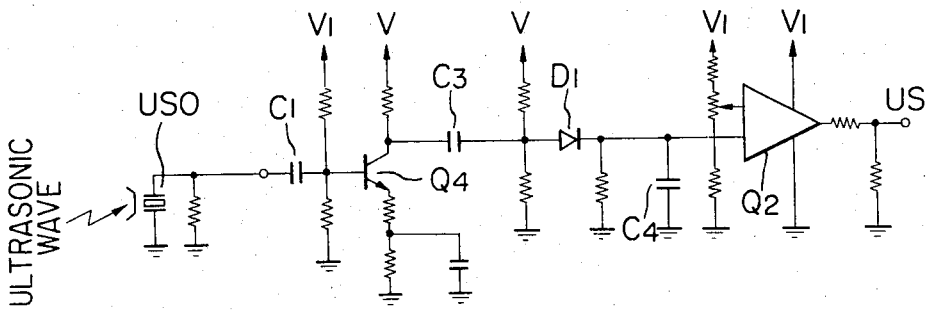
Figure 12C:
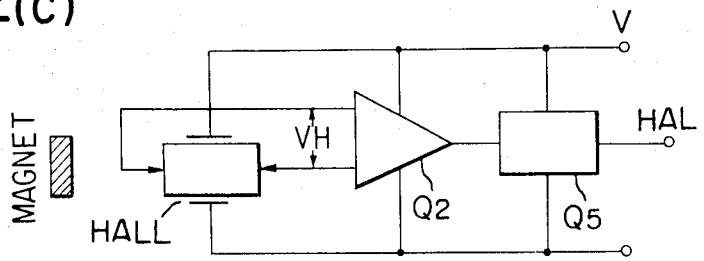

FIGS. 12(a), (b) and (c) show circuit examples of the various detectors for providing signals PH, US and HAL, respectively. In FIG. 12, Q1 designates a phototransistor, Q2 an operational amplifier, Q3 a voltage transforming transistor, USO an ultrasonic oscillator, Q4 an AC amplifier, $D_1$ and $C_4$ rectifiers, HALL a hall element, and Q5 a Schmidt trigger circuit.

TABLE 2

| | | | |
|---|---|---|---|
| | START | | |
| | NOP | | |
| | JUN | B001 | |
| | JUN | B002 | |
| B001 | LDM | 0 | |
| | FiM | 0,0 | |
| B003 | SRC | 0 | |
| | WRR | | All output ports reset |
| | iSZ | 0, B003 | |
| | JMS | $T_1$ | |
| B004 | FiM | 0,5 | Timer $T_1$ sub |
| | SRC | 0 | |
| | RDR | | |
| | RAR | | |
| | JC | B004 | |
| | LDM | 2 | IR = 0? |
| | FiM | 0,7 | |
| | SRC | 0 | |
| | WRR | | LED 6 ON |
| | FiM | X'E', X'DO' | |
| | LDM | 1 | |
| | FiM | 0,3 | |
| | SRC | 0 | |
| | WRR | | K1 ON |
| B005 | JMS | POS | |
| | XCH | X'F' | Print position sub |
| | RAL | | |
| | RAL | | |
| | JNC | B005 | Print position H? |
| | iSZ | X'E', B006 | |
| B007 | JMS | POS | |
| | XCH | X'F' | |
| | JNC | B005 | |
| | JUN | B007 | |
| B006 | LDM | 0 | |
| | FiM | 0,3 | |
| | SRC | 0 | |
| | WRR | | K1 OFF |
| | LDM | 0 | |
| | FiM | 0,7 | |
| | SRC | 0 | |
| | WRR | | LED6 OFF |
| | JMS | PH5 | |
| | JNC | B008 | PH5 H? |
| | LDM | 4 | |
| | FiM | 0,8 | |
| | SRC | 0 | |
| | WRR | | LED7 ON |
| | JUN | A001 | Print |
| B008 | LDM | 8 | |
| | FiM | 0,8 | |
| | SRC | 0 | |
| | WRR | | LED8 ON |
| | LDM | 2 | |
| | FiM | 0,3 | |
| | SRC | 0 | |
| | WRR | | K2 ON |

TABLE 2-continued

| | | | |
|---|---|---|---|
| | LDM | X'C' | |
| | FiM | 0,4 | |
| | SRC | 0 | |
| | WRR | | |
| B009 | JMS | POS | Grip position sub |
| | XCH | X'F' | |
| | RAR | | |
| | RAR | | |
| | JNC | B009 | |
| | JUN | A002 | Master preparation |

TABLE 3

| | | | |
|---|---|---|---|
| | T1 | LDM | 4 |
| | | XCH | 3 |
| | | FiM | 0,0 |
| | | LDM | 0 |
| | | XCH | 2 |
| | T01 | iSZ | 0, T01 |
| | | iSZ | 1, T01 |
| | | iSZ | 2, T01 |
| | | iSZ | 3, T01 |
| | | BBL | 0 |
| | POS | LDM | 3 |
| | | XCH | X'C' |
| | | SRC | X'C' + 1 |
| | | RDR | |
| | | XCH | X'F' |
| | | BBL | 0 |

TABLE 4

| | | | |
|---|---|---|---|
| B001 | JMS | POS | |
| | SCH | X'F' | |
| | RAR | | |
| | JNC | D001 | Master start? |
| | FiM | 0,X'80' | |
| | SRC | 0 | |
| | LDM | 0 | |
| | WRR | | LED8 OFF |
| | FiM | 0,X'30' | |
| | SRC | 0 | |
| | LDM | 1 | |
| | WRR | | K1 ON |
| | FiM | 0,X'60' | |
| | SRC | 0 | |
| | WRR | | |
| | LDM | 4 | LED1 ON |
| | FiM | 0,X'50' | |
| | SRC | 0 | |
| | WRR | | CL2 ON |
| | JMS | T2 | |
| | FiM | 0,X'40' | |
| | SRC | 0 | |
| | RDR | | |
| | RAL | | |
| | JNC | MJAM | |
| D002 | JMS | PH8 | |
| | JNC | D002 | |
| | FiM | 0,X'40' | |
| | SRC | 0 | |
| | LDM | | |
| | WRR | | SOL4, 5 OFF |
| | LDM | 0 | |
| | FiM | 0,X'50' | |
| | SRC | 0 | |
| | WRR | | CL2 OFF |
| | LDM | 1 | |
| | SRC | 0 | SOL1 ON |
| | JMS | T1 | |
| | LDM | 0 | |
| | SRC | 0 | SOL1 OFF |
| | JMS | T1 | |
| | FiM | 0,X'90' | |
| | SRC | 0 | |
| | LDM | 4 | |
| | WRR | | SOL6 ON |
| | LDM | 2 | |
| | FiM | 0,X'50' | |
| | SRC | 0 | |

TABLE 4-continued

| | | | |
|---|---|---|---|
| | WRR | | SOL2 ON |
| | LDM | 1 | |
| | FiM | 0,X'40' | |
| | SRC | 0 | |
| | WRR | | CL3 ON |
| D003 | JMS | PH2 | |
| | JNC | B003 | |
| | LDM | X'A' | |
| | FiM | 0,X'50' | |
| | SRC | 0 | |
| | WRR | | L1 ON |
| D004 | JMS | PH2 | |
| | JNC | D004 | |
| | LDM | 2 | |
| | SRC | 0 | |
| | WRR | | L1 OFF |
| | JMS | T3 | |
| | FiM | 0,X'50' | |
| | SRC | 0 | |
| | LDM | 0 | |
| | WRR | | SOL OFF |
| | FiM | 0,X'90' | |
| | SRC | 0 | |
| | LDM | 0 | |
| | WRR | | SOL6 OFF |
| B005 | JMS | POS | |
| | XCH | X'F' | |
| | RAL | | |
| | RAL | | |
| | JNC | D005 | |
| | JMS | PH5 | |
| | JC | MJAM | |
| | LDM | 0 | |
| | FiM | 0,X'30' | |
| | SRC | 0 | |
| | WRR | | K1 OFF |
| | LDM | 0 | |
| | FiM | 0,X'40' | |
| | SRC | 0 | |
| | WRR | | CL3 OFF |
| | FiM | 0,X'60' | |
| | SRC | 0 | |
| | WRR | | LED1 OFF |
| | LDM | 4 | |
| | FiM | 0,X'80' | |
| | WRR | | LED7 ON |
| | JUN | A001 | |

TABLE 5

| | | | |
|---|---|---|---|
| | A003 | | |
| | FiM | 0,X'30' | |
| | SRC | 0 | |
| | LDM | 1 | |
| | WRR | | K1 ON |
| d001 | JMS | POS | |
| | XCH | X'F' | |
| | RAL | | |
| | RAL | | |
| | JNC | d001 | |
| | LDM | 2 | |
| | SRC | 0 | |
| | WRR | | K1 ON, K1 OFF |
| | FiM | 0,X'80' | |
| | SRC | 0 | |
| | LDM | 0 | |
| | WRR | | LED7 OFF |
| | FiM | 0,X'60' | |
| | SRC | 0 | |
| | LDM | 2 | |
| | WRR | | LED2 ON |
| d002 | JMS | POS | |
| | XCH | X'F' | |
| | RAL | | |
| | RAL | | |
| | JC | d002 | |
| d003 | JMS | POS | |
| | XCH | X'F' | |
| | RAL | | |
| | RAL | | |
| | JNC | d003 | |

TABLE 5-continued

| | | | |
|---|---|---|---|
| | LDM | 6 | |
| | FiM | 0,X'40' | |
| | SRC | 0 | |
| | WRR | | SOL4, 5 ON |
| d004 | JMS | POS | |
| | XCH | X'F' | |
| | RAR | | |
| | RAR | | |
| | JNC | d004 | |
| | LDM | 0 | |
| | FiM | 0,X'30' | |
| | SRC | 0 | |
| | WRR | | K2 OFF |
| | JMS | PH5 | |
| | JC | MJAM | |
| | JMS | US2 | |
| | JNC | MJAM | |
| | JUN | A002 | |

What we claim is:

1. An automatic printing apparatus comprising:

an image formation member for forming a master which may be repetitively subjected to a process of reproducing an original image;

means for supporting the image formation member;

a rotatable body capable of holding said image formation member on a periphery thereof;

means for withdrawing the image formation member from said supporting means and for winding said member around said rotatable body;

optical means for projecting an original image upon said image formation member on said rotatable body;

heating means for heating said image formation member on said rotatable body to form said image formation member into a master carrying a permanent developed image of the original, said heating means being movable into and out of contact with said image formation member;

recording process means for repeatedly effecting a recording process including forming a latent image of the permanent image on the master, developing the latent image into a visible image and transferring the visible image onto a recording medium, said process means being located adjacent the periphery of said rotatable body;

means for bringing the recording medium into contact with the master at a transfer station for direct transfer of the visible image; and means for removing the master from said rotatable body after termination of operation of said recording process means;

wherein the master is formed on said rotatable body and removed therefrom after recording process operations, and wherein another image formation member is then wound around the rotatable body to form another master for repeating the recording process.

2. An apparatus according to claim 1, wherein said recording process means includes charging means for forming an electrostatic latent image corresponding to the permanent image on the master, and wherein the operations of said charging means and said image transfer means take place at the same position.

3. An apparatus according to claim 1, wherein said recording process means includes charging means for forming an electrostatic latent image corresponding to the permanent image on the master, and wherein during operation of said charging means, said developing means and said image transfer means, said heating means is spaced apart from said master.

4. An apparatus according to claim 1, wherein said recording process means includes charging means for forming an electrostatic latent image corresponding to the permanent image on the master, and further comprising secondary charging means for detecting the charged condition of said master imparted by said charging means and for further charging said master after said first-named charging to maintain said electrostatic image in a properly charged condition.

5. An apparatus according to claim 1, wherein said image formation member is mounted on said rotatable body in such a manner that the trailing end thereof overlaps a portion of the leading end thereof.

6. An apparatus according to claim 1, wherein the leading end portion of said image formation member is secured to said rotatable body while the other end portion thereof is free with respect to said rotatable body.

7. An apparatus according to claim 1, further comprising cleaning means for cleaning the surface of the master after the image transfer by said image transfer means has been effected.

8. An apparatus according to claim 1, further comprising cleaning means for intermittently cleaning the surface of the master after the image transfers by said image transfer means have been effected.

9. An apparatus according to claim 1, wherein said image formation member comprises a source of sheet material disposed in the interior of said rotatable body, and wherein said sheet material is disposed along a path leading from said interior, across a portion of the outer surface of said rotatable body, and back to said interior.

10. An apparatus according to claim 1, wherein said master may be separated from said rotatable body by reverse rotation of said rotatable body.

11. An apparatus according to claim 1, further comprising a plurality of process status display means for successively indicating the sequence of operations from the master formation to the image transfer.

12. An apparatus according to claim 1, further comprising means for discriminating whether said recording medium has been discharged from the apparatus, wherein such discrimination is made in accordance with the feeding time of said recording medium and the rotational position of said rotatable body.

13. An apparatus according to claim 1, wherein a first start position of said rotatable body at which said image formation member starts to wind around said rotatable body, is different from a second start position thereof at which said recording process means starts its process operation.

14. An apparatus according to claim 16, wherein said rotatable body temporarily stops at said second start position after it has started rotating from said first start position with said image formation member held by said rotatable body.

15. An apparatus according to claim 13, wherein said rotatable body temporarily stops at said first start position after it has started rotating from said second start position and has been repetitively acted on by said recording process means.

* * * * *

UNITED STATES PATENT AND TRADEMARK OFFICE

CERTIFICATE OF CORRECTION

PATENT NO. : 4,240,739

DATED : December 23, 1980

INVENTOR(S) : Noboru Koumura et al.

It is certified that error appears in the above—identified patent and that said Letters Patent is hereby corrected as shown below:

Column 1, line 67, "as" should be --a--;

Column 2, line 59, "an high" should be --a high--;

Column 4, line 36, "ae combined" should be --are combined--;

Column 7, line 20, "25" should be --35--;

Column 12, line 56, "other" should be --outer--;

Column 13, line 13, "therein" should be --thereon--;

Column 13, line 53, "opposite is" should be --opposite in--;

Column 15, line 14, "other" should be --outer--;

Column 17, line 13, "#0-#0" should be --#0-#9--;

Column 17, line 31, "positions" should be --position--;

UNITED STATES PATENT AND TRADEMARK OFFICE

CERTIFICATE OF CORRECTION

PATENT NO. : 4,240,739

DATED : December 23, 1980

INVENTOR(S) : Noboru Koumura et al.

It is certified that error appears in the above—identified patent and that said Letters Patent is hereby corrected as shown below:

Column 21, line 38, "(CY+0) should be --(CY=0)--;

Column 26, line 56, Claim 14, "16" should be --13--.

Signed and Sealed this

*Sixteenth* Day of *November 1982*

[SEAL]

*Attest:*

GERALD J. MOSSINGHOFF

*Attesting Officer* *Commissioner of Patents and Trademarks*